US009238882B2

(12) United States Patent
Takizawa et al.

(10) Patent No.: US 9,238,882 B2
(45) Date of Patent: Jan. 19, 2016

(54) NEEDLE BAR AND SEWING MACHINE

(71) Applicant: NSD CORPORATION, Nagoya-shi (JP)

(72) Inventors: Yoshichika Takizawa, Nagoya (JP); Hirotsugu Uenishi, Nagoya (JP)

(73) Assignee: NSD CORPORATION, Nagoya-shi (JP)

( * ) Notice: Subject to any disclaimer, the term of this patent is extended or adjusted under 35 U.S.C. 154(b) by 0 days.

(21) Appl. No.: 14/411,557

(22) PCT Filed: Mar. 11, 2013

(86) PCT No.: PCT/JP2013/056656
§ 371 (c)(1),
(2) Date: Dec. 29, 2014

(87) PCT Pub. No.: WO2014/034160
PCT Pub. Date: Mar. 6, 2014

(65) Prior Publication Data

US 2015/0152582 A1 Jun. 4, 2015

(30) Foreign Application Priority Data

Aug. 29, 2012 (JP) ..... 2012-189289
Sep. 3, 2012 (JP) ..... 2012-193379

(51) Int. Cl.
*D05B 55/14* (2006.01)
*D05B 55/02* (2006.01)
*D05B 87/02* (2006.01)

(52) U.S. Cl.
CPC ..... *D05B 55/14* (2013.01); *D05B 55/02* (2013.01); *D05B 87/02* (2013.01)

(58) Field of Classification Search
CPC ..... D05C 15/20; D05B 55/14; D05B 85/00; D05B 49/04; D05B 15/025; D05B 3/14
USPC ..... 112/80.4, 80.8, 221, 222, 248, 249, 49, 112/111, DIG. 3
See application file for complete search history.

(56) References Cited

U.S. PATENT DOCUMENTS 2,422,126 A * 6/1947 Parker ..... 112/80.04
3,595,186 A * 7/1971 Shorrock et al. ..... 112/80.08
3,913,508 A * 10/1975 Boser ..... 112/221
3,938,452 A * 2/1976 Windle ..... 112/80.06
4,129,084 A * 12/1978 Kihara ..... 112/221
8,978,566 B2 * 3/2015 Hasegawa et al. ..... 112/470.05

* cited by examiner

*Primary Examiner* — Tejash Patel
(74) *Attorney, Agent, or Firm* — Locke Lord LLP

(57) ABSTRACT

In relation to a sewing machine having a function of rotating a sewing needle in order to prevent occurrence of hitch stitches, there is provided a needle bar that obviates a necessity for an additional rotation mechanism for rotating the sewing needle.

A needle bar includes: a needle bar body having a vertically-movable sleeve and a guide bush; a sleeve provided in the needle bar body and having openings, and the like, where balls are to be placed; a cam shaft that has a disc-shaped portion which is provided in the needle bar body, an upper shaft which is provided with a pair of grooves or the like having helical grooves and which is inserted in the sleeve, and a lower shaft which is formed so as to protrude downward from a guide bush; and a joint secured to the lower shaft for securing a sewing needle.

20 Claims, 27 Drawing Sheets

NEEDLE BAR AND SEWING MACHINE

TECHNICAL FIELD

The present invention relates to a needle bar for use with a sewing machine and, more particularly, to a needle bar used in an embroidery sewing machine and a sewing machine.

BACKGROUND ART

Stitch patterns used in sewing work of sewing machines include perfect stitches and hitch stitches. Perfect stitches are generally said to be normal stitches wavily made up of a needle thread and a bobbin thread. In the meantime, the hitch stitches are stitches that are formed when the needle thread is twisted on a per-stitch basis, thereby forming loops, and the bobbin thread is inserted into the loops.

In relation to the hitch stitches, difficulty is encountered in fastening the stitches uniformly by tightening the needle thread with a thread take-up lever, and slack again occurs in the stitches after the needle thread is tightened. Therefore, when the hitch stitches and the perfect stitches are mixedly woven, there arises a problem of stitch quality with uniform-spread stitches being hardly attained.

In order to prevent occurrence of the hitch stitches, Patent Documents 1 through 4 disclose rotating a sewing needle attached to a needle bar by rotating the needle bar around its axis of reciprocating motion.

For instance, in an automatic sewing machine disclosed in connection with Patent Document 1, a needle bar is rotated by a motor which rotates a needle bar drive unit, a spur gear which is rotated by the motor, and another spur gear, a drive shaft, still another spur gear, and an intermediate gear, etc. They transmit torque of the spur gear rotated by the motor successively.

In an automatic sewing machine disclosed in connection with Patent Document 2, a needle is rotated by a needle rotation motor.

Further, in Patent Document 3, a gear (a first gear) meshes with another gear (a second gear) fixed to a motor, and a needle bar slidably fitted into a groove of the first gear is rotated by rotation of the motor.

As illustrated in FIG. 27, in relation to a needle bar rotation mechanism of a sewing machine described in connection with Patent Document 4, a hole is opened in each of parallel pieces of a C-shaped receiving element 505*a* in a needle bar connecting stud 505. A sleeve 506 is inserted into the C-shaped space of the needle bar connecting stud 505, and a needle bar 508 penetrate through the holes and a hole of the sleeve 506. A screw 507 is inserted into a screw hole opened in the sleeve 506, and the sleeve 506 and the needle bar 508 are fastened by the screw 507. The needle bar 508 is rotatably held in a vertically-movable manner by braces 509*a* and 509*b* attached to a needle bar supporter 509. A cam groove 508*a* is formed in the needle bar 508. A needle bar guide pin 510 fixed to the brace 509*a* is engaged with the cam groove 508*a*. With this configuration, the needle bar 508 is thereby moved in the vertical direction while being rotated by means of vertical movement of the needle bar connecting stud 505.

RELATED-ART DOCUMENTS

Patent Documents

Patent Document 1: Japanese Patent Laid-Open No. 63-105785

Patent Document 2: Japanese Patent Laid-Open No. 3-63091

Patent Document 3: Japanese Patent Laid-Open No. 63-196756

Patent Document 4: Japanese Patent Laid-Open No. 54-126157

SUMMARY OF THE INVENTION

Problems to be Solved by the Invention

However, the configurations of Patent Documents 1 through 3 additionally require a rotation mechanism (a motor, a gear, etc.) for rotating the needle bar and hence are difficult to apply to existing sewing machines.

Moreover, the needle bar rotation mechanism described in connection with Patent Document 4 encounters problems; namely, difficulty in replacing a needle bar, difficulty in smoothly rotating the needle bar, and difficulty in applying the needle bar rotation mechanism to existing sewing machines.

Specifically, when an attempt is made to replace the needle bar of the needle bar rotation mechanism described in connection with Patent Document 4, the needle bar 508 must be detached. However, the needle bar 508 must be pulled out downwardly after the screw 507 is unscrewed at the time of replacement of the needle bar 508 because the guide pin 510 is engaged with the cam groove 508*a*. Since a shuttle, or the like, is usually placed beneath the needle bar, the needle bar cannot be pulled out downward, as a result of which the needle bar cannot be taken out. So long as the needle bar guide pin 510 is disengaged from the cam groove 508*a* by being pulled outside, the needle bar 508 can be upwardly pulled out of the two receptacles 509*a*, 509*b*, the needle bar connecting stud 505, and the sleeve 506. However, there is needed a task of disengaging the needle bar guide pin 510 from the cam groove 508*a* by pulling the needle bar guide pin 510 outside.

Further, when the needle bar is attached (in other words, at the time of replacement or first attachment of the needle bar), a needed task is to insert the needle bar into the two braces 509*a*, 509*b*, the needle bar connecting stud 505, and the sleeve 506 (i.e., a total of four members), to bring the needle bar guide pin 510 into engagement with the cam groove 508*a*, and to fasten the screw 507. Moreover, even when the needle bar 508 is inserted into four members (the two braces 509*a*, 509*b*, the needle bar connecting stud 505, and the sleeve 506), the sleeve 506 must be positioned in the needle bar connecting stud 505 on occasion when the needle bar 508 is inserted into the needle bar connecting stud 505 and the sleeve 506. Hence, a task of inserting the needle bar 508 into the needle bar connecting stud 505 and the sleeve 506 is troublesome.

The needle bar rotation mechanism described in connection with Patent Document 4 has a configuration in which the needle bar guide pin 510 is engaged with the cam groove 508*a*. Accordingly, when the needle bar guide pin 510 slides through the inside of the cam groove 508*a*, friction occurs between the needle bar guide pin 510 and the cam groove 508*a*, which poses difficulty in smooth rotation of the needle bar 508.

The needle bar rotation mechanism described in connection with Patent Document 4 has a configuration in which the needle bar 508 is held by the braces 509*a* and 509*b* attached to the needle bar supporter 509. Accordingly, the needle bar supporter 509 and the braces 509*a*, 509*b* require space, which results in a problem of the needle bar rotation mechanism being hardly applied to existing sewing machines. In particular, when an attempt is made to apply the needle bar rotation mechanism to existing multi-needle embroidery sewing machines, the brace 509*b* cannot be placed especially at a position below the needle bar because a presser foot connecting stud and a presser foot spring are disposed at that position.

Accordingly, in relation to a sewing machine having a function of rotating a sewing needle in order to prevent occurrence of hitch stitches, the present invention provides a needle bar that obviates a need for an additional rotation mechanism for rotating the sewing needle; that facilitates attachment and replacement of a needle bar; that facilitates smooth rotation of the sewing needle on occasion of rotation of the sewing needle; and that is easily applied to existing sewing machines, as well as providing a sewing machine having the needle bar.

Means for Solving the Problems

The present invention has been created in order to solve the problems. First, there is provided a sewing needle bar comprising:

- a tubular needle bar body (10) including
  - a small-diameter portion (10-1) which is provided at a lower end of the needle bar body and which has a hole (which may also be referred to as a "hole having a cylindrical inner circumferential surface") opened along an axis line of the needle bar body and
  - a large-diameter portion (10-2) which is continually provided on an upper side of the small-diameter portion and which has a hole (which may also be referred to as a "hole having a cylindrical inner circumferential surface") opened larger in diameter than the hole of the small-diameter portion and along the axis line of the needle bar body;
- a cylindrical sleeve (20) which is inserted in the hole of the large-diameter portion of the needle bar body and which has an opening for placing a ball;
- a cam shaft (30) including
  - a disc-shaped portion (32) which is placed on an upper surface of the small-diameter portion in the needle bar body in a rotatable manner and which has an outer diameter larger than a diameter of the hole of the small-diameter portion,
  - a spindle-shaped upper shaft (34) which is formed upwardly from the upper surface of the disc-shaped portion and remains inserted in the sleeve and whose outer circumferential surface has a clockwise helical groove, and
  - a spindle-shaped lower shaft (36) which is formed downwardly from a lower surface of the disc-shaped portion and remains inserted in the hole of the small-diameter portion of the needle bar body and which protrudes downwardly from a lower end of the small-diameter portion;
- a ball (22) which is placed in the opening of the sleeve and which come into engagement with the groove of the upper shaft; and
- a joint (50) which is secured to the lower shaft while the small-diameter portion of the needle bar body are sandwiched between the joint and the disc-shaped portion and which is intended for fixing a sewing needle, wherein
- changes occur in relative positions of the ball in the groove as a result of the needle bar body being vertically moved while a portion of the sleeve protruding upward from the needle bar body remains fixed, whereupon the cam shaft and the joint rotate.

In the needle bar having the first configuration, the sewing needle is secured to the joint, and the sleeve is secured to a fixed member, like a housing of a sewing machine etc., and the needle bar connecting stud is secured to the needle bar body. In this state, the needle bar connecting stud is vertically moved, whereby the needle bar body is vertically moved. As a consequence, changes occur in relative positions of the ball, which are provided in the opening of the sleeve, in the helical groove formed in the upper shaft. The cam shaft is thereby rotated, and the joint and the sewing needle are rotated along with rotation of the cam shaft. Since the helical groove is formed clockwise, the cam shaft, the joint, and the sewing needle rotate counterclockwise in the course of shifting from the bottom dead center to the top dead center when viewed from above. Further, they rotate clockwise in the course of shifting from the top dead center to the bottom dead center when viewed from above. Since the sewing needle rotate counterclockwise in the course of shifting from the bottom dead center to the top dead center, occurrence of hitch stitches can be prevented.

In relation to the needle bar having the first configuration, the sleeve is brought into a secured state, whereby the sewing needle is rotated by vertical movement of the needle bar body. Hence, an additional rotation mechanism for rotating the needle bar is unnecessary.

Except the sleeve being secured, the needle bar can be handle in the same way as is an ordinary sewing needle. Therefore, at the time of replacement of the needle bar, the needle bar is removed from the needle bar connecting stud, etc., in the same way as is an ordinary needle bar except the sleeve being unfastened. Even at the time of attachment of the needle bar, the only requirement is to do is to perform work for securing the needle bar connecting stud to the needle bar body, except the sleeve being secured, in the same way as is an ordinary needle bar. Therefore, attachment and replacement of the needle bar is easy.

On occasion when the cam shaft rotates, the ball rotate within the opening and the groove. Therefore, friction between the ball and the sleeve and friction between the ball and the cam shaft can be diminished, so that the cam shaft and the sewing needle can smoothly rotate. The needle bar can be applied to existing sewing machines by means of adoption of only the configuration that secures the sleeve. Hence, the needle bar can accordingly be applied to existing sewing machines easily. In addition, the needle bar itself entirely assumes an approximately-cylindrical shape which is similar to appearance of ordinary sewing needles. Even in this regard, the sewing needle can be easily applied to existing sewing machines.

The aforementioned first configuration can also be modified as follows. Specifically, there is provided a sewing needle bar comprising:

- a tubular needle bar body (10) including
  - a small-diameter portion (10-1) which is provided at a lower end of the needle bar body and which has a hole (which may also be referred to as a "hole having a cylindrical inner circumferential surface") opened along an axis line of the needle bar body and
  - a large-diameter portion (10-2) which is continually provided on an upper side of the small-diameter portion and which has a hole (which may also be referred to as a "hole having a cylindrical inner circumferential surface") opened larger in diameter than the hole of the small-diameter portion and along the axis line of the needle bar body;
- a cylindrical sleeve (20) which is inserted in the hole of the large-diameter portion of the needle bar body and larger in diameter than the hole of the small-diameter portion and which has an opening for placing a ball;
- a cam shaft (30) including a disc-shaped portion (32) which is placed on an upper surface of the small-diameter portion in the needle bar body in a rotatable manner and which has an outer diameter larger than a diameter of the hole of the small-diameter portion, a spindle-shaped upper shaft (34) which is formed upwardly from the upper surface of the disc-shaped portion and remains inserted in the sleeve and whose outer circumferential surface has a clockwise helical groove, and a spindle-shaped lower shaft (36) which is formed downwardly from a lower surface of the disc-shaped portion and remains inserted in the hole of the small-diameter portion of the needle bar body and which protrudes downwardly from a lower end of the small-diameter portion;

a ball (22) which are placed in the opening of the sleeve and which come into engagement with the groove of the upper shaft; and a joint (50) which is secured to the lower shaft while the small-diameter portion of the needle bar body are sandwiched between the joint and the disc-shaped portion and which is intended for fixing a sewing needle, wherein changes occur in relative positions of the ball in the respective groove as a result of the needle bar body being vertically moved while a portion of the sleeve protruding upward from the needle bar body remains fixed, whereupon the cam shaft and the joint rotate.

Second, in relation to the first configuration, the opening (20*a*, 20*b*) of the sleeve is provided as a pair; the pair of openings are positioned opposite with an axis line of the sleeve sandwiched therebetween; the groove of the upper shaft is provided as a pair; the pair of grooves (36*a*, 36*b*) are at positions that are symmetrical about an axis line of the upper shaft; and the ball is provided as a pair, wherein one of the pair of balls is placed in one of the openings and in engagement with one of the grooves, and the other of the pair of balls is placed in the other of the grooves and in engagement with the other of the grooves.

Third, in relation to the first or second configuration, there is additionally provided with a holder (70) which holds a sleeve and is provided on a portion of the sleeve protruding upward from the needle bar body and which has securing means (86) for securing the holder to a support member (which may be referred to also as a "fixed member which is a member other than the needle bar") of the sewing machine. The holder is attached to the sleeve, and this holder is further secured to the fixed member, so that the sleeve can be brought into a secured state.

Fourth, in relation to the third configuration, the holder has a cylindrical cover (90) which extends downwards and which covers a part of the sleeve exposed from the needle bar body and an upper end of the needle bar body. Therefore, intrusion of contaminants, like dust, into clearance between the needle bar body and the sleeve can be prevented.

Fifth, there is provided a sewing needle bar comprising:

a tubular needle bar body (110) including a small-diameter portion (10-1) which is provided at a lower end of the needle bar body and which has a hole (which may also be referred to as a "hole having a columnar inner circumferential surface") opened along an axis line of the needle bar body and a large-diameter portion (10-2) which is continually followed by the small-diameter portion and which has a hole (which may also be referred to as a "hole having a columnar inner circumferential surface") larger in diameter than the hole of the small-diameter portion opened along the axis line of the needle bar body;

a rotation section (120) including a cylindrical sleeve (122) which is inserted in the hole of the large-diameter portion of the needle bar body and which has an opening for placement of a ball, a disc-shaped portion (126) which is fixed to a lower end of the sleeve, which is provided on an upper surface of the small-diameter portion in the needle bar body in a rotatable manner, and which has an outer diameter larger than a diameter of the hole of the small-diameter portion, and a spindle-shaped lower shaft (128) which is formed downwardly on a lower surface of the disc-shaped portion and inserted in the hole of the small-diameter portion of the needle bar body and which protrudes downwardly from a lower end of the small-diameter portion;

a cam shaft (130) which is inserted in the sleeve and whose outer circumferential surface has a clockwise helical groove;

a ball (22) which is placed in the opening of the sleeve and which come into engagement with the groove of the cam shaft; and a joint (150) which is secured to the lower shaft of the rotation section with the small-diameter portion of the needle bar body sandwiched between the joint and the disc-shaped portion and which secures a sewing needle, wherein changes occur in relative positions of the ball in the groove as a result of vertical movement of the needle bar body while a portion of the cam shaft protruding upward from the needle bar body and the sleeve is secured, whereupon the rotation section and the joint rotate.

In the needle bar having the fifth configuration, the needle bar is secured to the joint, and the cam shaft is secured to a fixed member, like a housing of the sewing machine etc., and the needle bar connecting stud is secured to the needle bar body. The needle bar connecting stud is then vertically moved, thereby vertically moving the needle bar body. As a consequence, Changes occur in relative positions of the ball, which are provided in the opening of the sleeve, in the helical groove formed in the cam shaft. The rotation section is thereby rotated, and the joint and the sewing needle rotate along with rotation of the rotation section. Since the helical groove is formed clockwise, the rotation section, the joint, and the sewing needle rotate counterclockwise in the course of shifting from the bottom dead center to the top dead center when viewed from above. Further, they also rotate clockwise in the course of shifting from the top dead center to the bottom dead center when viewed from above. Since the sewing needle rotates counterclockwise in the course of shifting from the bottom dead center to the top dead center, occurrence of hitch stitches can be prevented.

In relation to the needle bar having the fifth configuration, the cam shaft is brought into a secured state, whereby the sewing needle rotates by vertical movement of the needle bar body. Hence, an additional rotation mechanism for rotating the needle bar is unnecessary.

Except the cam shaft being secured, the needle bar can be handled in the same way as is an ordinary needle bar. Accordingly, at the time of replacement of a needle bar, the needle bar is removed from the needle bar connecting stud, etc., in the same way as is an ordinary needle bar except the cam shaft being unfastened. Even at the time of attachment of a needle bar, the only requirement is to perform work for securing the needle bar connecting stud to the needle bar in the same way as is an ordinary needle bar except the cam shaft being secured. Hence, attachment and replacement of the needle bar are easy.

On occasion when the rotation section rotates, the ball rotate within the opening and the groove. Therefore, friction between the ball and the sleeve and friction between the ball and the cam shaft can be diminished, so that the rotation section and the sewing needle can smoothly rotate. The needle bar can be applied to existing sewing machines by means of adoption of only the configuration that secures the cam shaft. Hence, the needle bar can accordingly be applied to existing sewing machines easily. In addition, the needle bar itself entirely assumes an approximately-cylindrical shape which is similar to appearance of ordinary sewing needles. Even in this regard, the sewing needle can be easily applied to existing sewing machines.

Fifth, the fifth configuration may also be modified as follows: Specifically, there is provided a sewing needle bar comprising:

a tubular needle bar body (110) including a small-diameter portion (10-1) which is provided at a lower end of the needle bar body and which has a hole (which may also be referred to as a "hole having a columnar inner circumferential surface") opened along an axis line of the needle bar body and a large-diameter portion (10-2) which is continually followed by the small-diameter portion and which has a hole (which may also be referred to as a "hole having a columnar inner circumferential surface") larger in diameter than the hole of the small-diameter portion opened along the axis line of the needle bar body;

a rotation section (120) including a cylindrical sleeve (122) which is inserted in the hole of the large-diameter portion of the needle bar body and is larger in diameter than the hole of the small-diameter portion and which has an opening for placement of a ball, a disc-shaped portion (126) which is fixed to a lower end of the sleeve and provided on an upper surface of the small-diameter portion in the needle bar body in a rotatable manner and which has an outer diameter larger than a diameter of the hole of the small-diameter portion, and a spindle-shaped lower shaft (128) which is formed downwardly on a lower surface of the disc-shaped portion and inserted in the hole of the small-diameter portion of the needle bar body and which protrudes downwardly from a lower end of the small-diameter portion;

a cam shaft (130) which is inserted in the sleeve and whose outer circumferential surface has a clockwise helical groove;

a ball (22) which is placed in the opening of the sleeve and which come into engagement with the groove of the cam shaft; and a joint (150) which is secured to the lower shaft of the rotation section with the small-diameter portion of the needle bar body sandwiched between the joint and the disc-shaped portion and which secures a sewing needle, wherein changes occur in relative positions of the ball in the groove as a result of vertical movement of the needle bar body while a portion of the cam shaft protruding upward from the needle bar body and the sleeve is secured, whereupon the rotation section and the joint rotate.

Sixth, in relation to the fifth configuration, the opening (120*a*, 120*b*) of the sleeve is provided as a pair; the pair of openings are positioned opposite with an axis line of the sleeve sandwiched therebetween; the groove of the upper shaft is provided as a pair; the pair of grooves (136*a*, 136*b*) are at positions that are symmetrical about an axis line of the upper shaft; and the ball is provided as a pair, wherein one of the pair of balls is placed in one of the openings and in engagement with one of the grooves, and the other of the pair of balls is placed in the other of the grooves and in engagement with the other of the grooves. Since the openings, the grooves, and the balls are each provided as a pair, the cam shaft can be smoothly rotated.

Seventh, in relation to the fifth or sixth configuration, there is additionally provided with a holder (170) which holds the cam shaft and is provided on a portion of the cam shaft protruding upward from the needle bar body and the sleeve and which has securing means for securing the holder to a support member (which may be referred to also as a "fixed member which is a member other than the needle bar") of the sewing machine.

The holder is attached to the cam shaft, and this holder is further secured to the fixed member, so that the cam shaft can be brought into a secured state.

Eighth, in relation to the seventh configuration, the holder has a cylindrical cover (190) which extends downwards and which covers a portion of the cam shaft exposed from the needle bar body and an upper end of the needle bar body. Therefore, intrusion of contaminants, like dust, into clearance between the sleeve and the cam shaft can be prevented.

Ninth, in relation to any of the first through eighth configurations, the needle bar body has a cylindrical needle bar body sleeve (12, 112) and a guide bush (14) that is provided at a lower end of the needle bar body sleeve and that includes a cylindrical guide bush body (16) and a cylindrical flange (18) formed so as to protrude from an outer circumferential surface of a lower end of the guide bush body;

a portion of the guide bush body where no flange is formed is fixedly provided within the needle bar body sleeve;

a portion of the needle bar body from an upper end of the needle bar body sleeve to an upper end of the guide bush along a heightwise direction of the needle bar body makes up a large-diameter portion; and a portion of the needle bar body from the upper end to a lower end of the guide bush in the heightwise direction of the needle bar body makes up a small-diameter portion.

Therefore, the needle bar body having the large-diameter portion and the small-diameter portion can be easily configured by means of the needle bar body sleeve and the guide bush.

Tenth, in relation to any one of the first through ninth configurations, the joint has a joint body (52, 152) including a hole (52K, 152K) for insertion of the lower shaft and the sewing needle, a lower-shaft-securing threaded hole (52*a*, 152*a*) opened between an outer surface of the joint and the hole, and a sewing-thread-securing threaded hole (52*b*, 152*b*) opened between an outer surface of the joint and the hole;

a first screw (54, 154) which is to be screw-engaged with the lower-shaft-securing threaded hole, and a second screw (56, 156) which is to be screw-engaged with the sewing-thread-securing threaded hole; and wherein the lower shaft is secured to the joint by screw-engaging the first thread with the lower-shaft securing threaded hole while the lower shaft is inserted in the hole, and the sewing thread is secured to the joint by screw-engaging the second screw with the sewing-thread-securing threaded hole while the sewing thread is inserted in the hole.

Eleventh, in relation to any one of the first through ninth configurations, the joint has a joint body (52, 152) including a first hole (52K-1, 152K-1) for insertion of the lower shaft, a second hole (52K-2, 152K-2) for insertion of the sewing needle, a lower-shaft-securing threaded hole (52*a*, 152) opened between an outer surface of the joint and the first hole, and a sewing-thread-securing threaded hole (52*b*, 152*b*) opened between an outer surface of the joint and the second hole;

a first screw (54, 154) which is to be screw-engaged with the lower-shaft-securing threaded hole, and a second screw (56, 156) which is to be screw-engaged with the sewing-thread-securing threaded hole; and wherein the lower shaft is secured to the joint by screw-engaging the first thread with the lower-shaft securing threaded hole while the lower shaft is inserted in the first hole, and the sewing thread is secured to the joint by screw-engaging the second screw with the sewing-thread-securing threaded hole while the sewing thread is inserted in the second hole.

Twelfth, a sewing machine comprising:

the needle bar defined in any of the third, fourth, seventh, and eighth configurations;

the sewing needle (60, 160) secured to the joint of the needle bar;

a needle bar connecting stud (220, 330) fixedly provided on a needle bar body of the needle bar;

a needle bar connecting stud up/down mechanism (which may also be referred to as a "needle bar connecting stud vertically-movable mechanism") (206, 340) for vertically moving the needle bar connecting stud; and a support member (216, 314) for fixedly supporting a holder of the needle bar with the securing means.

In the sewing machine having the twelfth configuration, the sewing needle is rotated by vertical movement of the sewing bar body. Therefore, an additional rotation mechanism for rotating the needle bar is not necessary.

Except a member to be secured, like a sleeve and a cam shaft, being secured, the needle bar can be handled in the same way as is an ordinary needle bar. Accordingly, at the time of replacement of a needle bar, the needle bar is removed from the needle bar connecting stud, etc., in the same way as is an ordinary needle bar except the member to be secured being unfastened. Even at the time of attachment of a needle bar, the only requirement is to perform work for securing the needle bar connecting stud to the needle bar in the same way as is an ordinary needle bar except the member to be secured being fastened. Hence, attachment and replacement of the needle bar are easy.

On occasion when the cam shaft or the rotation section rotates, the ball rotate within the opening and the groove. Therefore, friction between the ball and the sleeve and friction between the ball and the cam shaft can be diminished, so that the cam shaft or the rotation section and the sewing needle can smoothly rotate.

The needle bar can be easily applied to existing sewing machines by means of only providing the support member for fixing the member to be secured. Hence, the needle bar can accordingly be applied to existing sewing machines easily. In addition, the needle bar itself entirely assumes an approximately-cylindrical shape which is similar to appearance of ordinary sewing needles. Even in this regard, the sewing needle can be easily applied to existing sewing machines.

Thirteenth, in relation to the twelfth configuration, the sewing machine is an embroidery sewing machine and comprises an arm (201) having the needle bar connecting stud up/down mechanism and a needle bar case (210) which performs horizontal sliding with respect to the arm and which is equipped with the plurality of needle bars and the support member. Therefore, even when the sewing machine is an embroidery sewing machine, the needle bar can be applied to existing embroidery sewing machines by means of only providing the needle bar case with the support member. Hence, the sewing needle can be easily applied to the existing embroidery sewing machines.

Advantages of the Invention

In relation to the needle bar according to claim 1 based on the present invention, the sleeve is brought into a secured state, whereby the sewing needle is rotated by vertical movement of the needle bar body. Hence, an additional rotation mechanism for rotating the needle bar is unnecessary. Moreover, except that the sleeve is secured, the needle bar can be handle in the same way as is an ordinary sewing needle. Therefore, at the time of replacement of the needle bar, the needle bar is removed from the needle bar connecting stud, etc., in the same way as is an ordinary needle bar except the sleeve being unfastened. Even at the time of attachment of the needle bar, all you need to do is to perform work for securing the needle bar connecting stud to the needle bar body, except the sleeve being secured, in the same way as is an ordinary needle bar. Therefore, attachment and replacement of the needle bar is easy.

On occasion when the cam shaft rotates, the ball rotate within the opening and the groove. Therefore, friction between the ball and the sleeve and friction between the ball and the cam shaft can be diminished, so that the cam shaft and the sewing needle can smoothly rotate. The needle bar can be applied to existing sewing machines by means of adoption of only the configuration that secures the sleeve. Hence, the needle bar can accordingly be applied to existing sewing machines easily. In addition, the needle bar itself entirely assumes an approximately-cylindrical shape which is similar to appearance of ordinary sewing needles. Even in this regard, the sewing needle can be easily applied to existing sewing machines.

In relation to the needle bar according to claim 5, the cam shaft is brought into a secured state, whereby the sewing needle rotates by vertical movement of the needle bar body. Hence, an additional rotation mechanism for rotating the needle bar is unnecessary. Except the cam shaft being secured, the needle bar can be handled in the same way as is an ordinary needle bar. Accordingly, at the time of replacement of a needle bar, the needle bar is removed from the needle bar connecting stud, etc., in the same way as is an ordinary needle bar except the cam shaft being unfastened. Even at the time of attachment of a needle bar, the only requirement is to perform work for securing the needle bar connecting stud to the needle bar in the same way as is an ordinary needle bar except the cam shaft being secured. Hence, attachment and replacement of the needle bar are easy.

On occasion when the rotation section rotates, the ball rotate within the opening and the groove. Therefore, friction between the ball and the sleeve and friction between the ball and the cam shaft can be diminished, so that the rotation section and the sewing needle can smoothly rotate. The needle bar can be applied to existing sewing machines by means of adoption of only the configuration that secures the cam shaft. Hence, the needle bar can accordingly be applied to existing sewing machines easily. In addition, the needle bar itself entirely assumes an approximately-cylindrical shape which is similar to appearance of ordinary sewing needles. Even in this regard, the sewing needle can be easily applied to existing sewing machines.

EMBODIMENT FOR CARRYING OUT THE INVENTION

Figure 1:
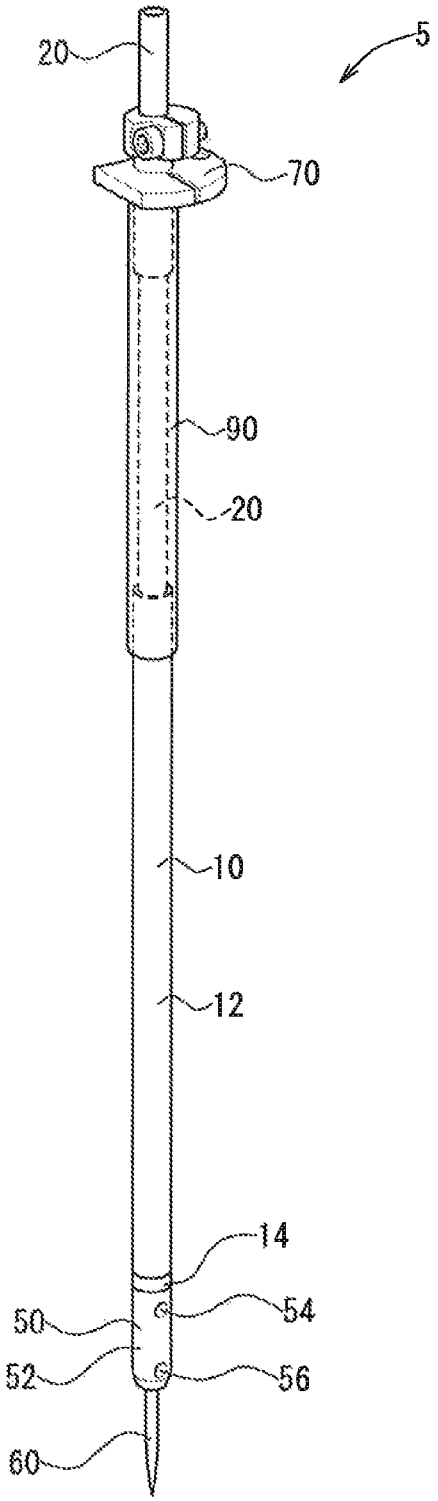
FIG. 1 is a perspective view of a needle bar (a first example)
Figure 2:
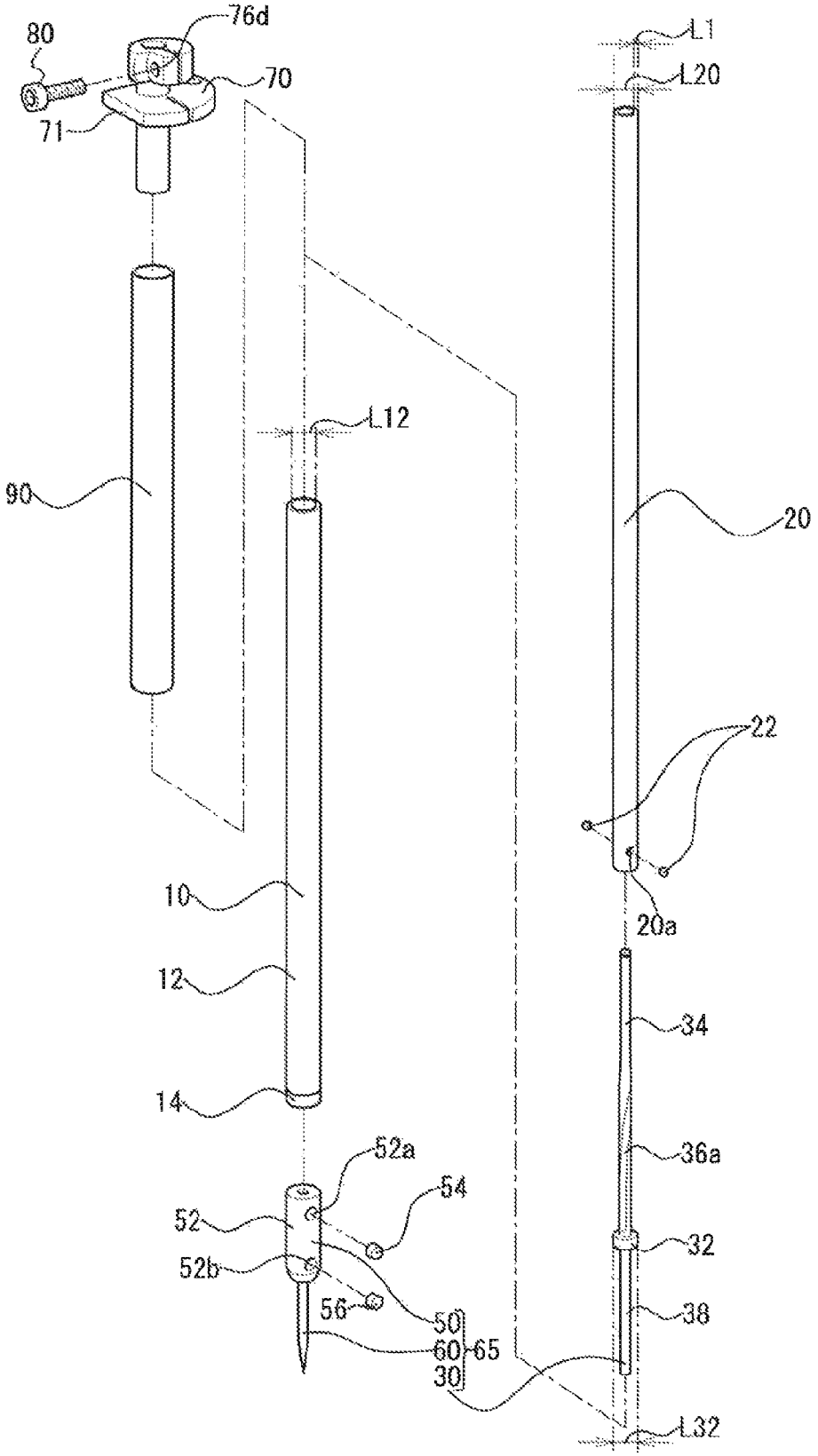
FIG. 2 is an exploded perspective view of the needle bar (the first example)

The present invention is directed toward as follows a sewing machine having a function of rotating a sewing needle in order to prevent occurrence of hitch stitches and a needle bar used in the sewing machine and has attained an objective of providing a needle bar that obviates a need for an additional rotation mechanism for rotating the sewing needle, that is easy to attach or replace, that easily performs smooth rotation during rotation of the sewing needle, and that is easy to apply to existing sewing machines, as well as providing a sewing machine equipped with the needle bar.

First Example

A needle bar 5 of the present example is a sewing needle bar. The needle bar 5 is configured as illustrated in FIG. 1 through FIG. 7 and entirely assumes an approximately-columnar shape. The needle bar 5 has a needle bar body 10; a sleeve 20 placed in the needle bar body 10; balls 22, one in an opening 20*a* and the other in an opening 20*b* of the sleeve 20; a cam shaft 30 having an upper shaft 34 (which will be described later) to be placed in the sleeve 20 and a disc-shaped portion 32 and a lower shaft 38 which are provided in the needle bar body 10; a joint 50 that is secured to the cam shaft 30 and placed at a lower position on and rotatable with respect to the needle bar body 10 in order to secure a sewing needle 60; a holder 70 that fixedly holds the sleeve 20 and fastens the needle bar 5 to another member; and a cover 90 fixedly provided on the holder 70 for sheathing the sleeve 20. A sewing needle (which may also be referred simply as a "needle") 60 is fixedly provided on the joint 50.

The needle bar body 10 has a vertically-movable sleeve (a sleeve for a needle bar body) 12 and a guide bush 14 disposed at a lower end of the vertically-movable sleeve 12. An outer circumferential surface of the needle bar body 10 assumes a columnar shape (or can also assume an approximately-columnar shape), thus exhibiting a tubular shape in which holes are opened along an axis line.

Figure 13:
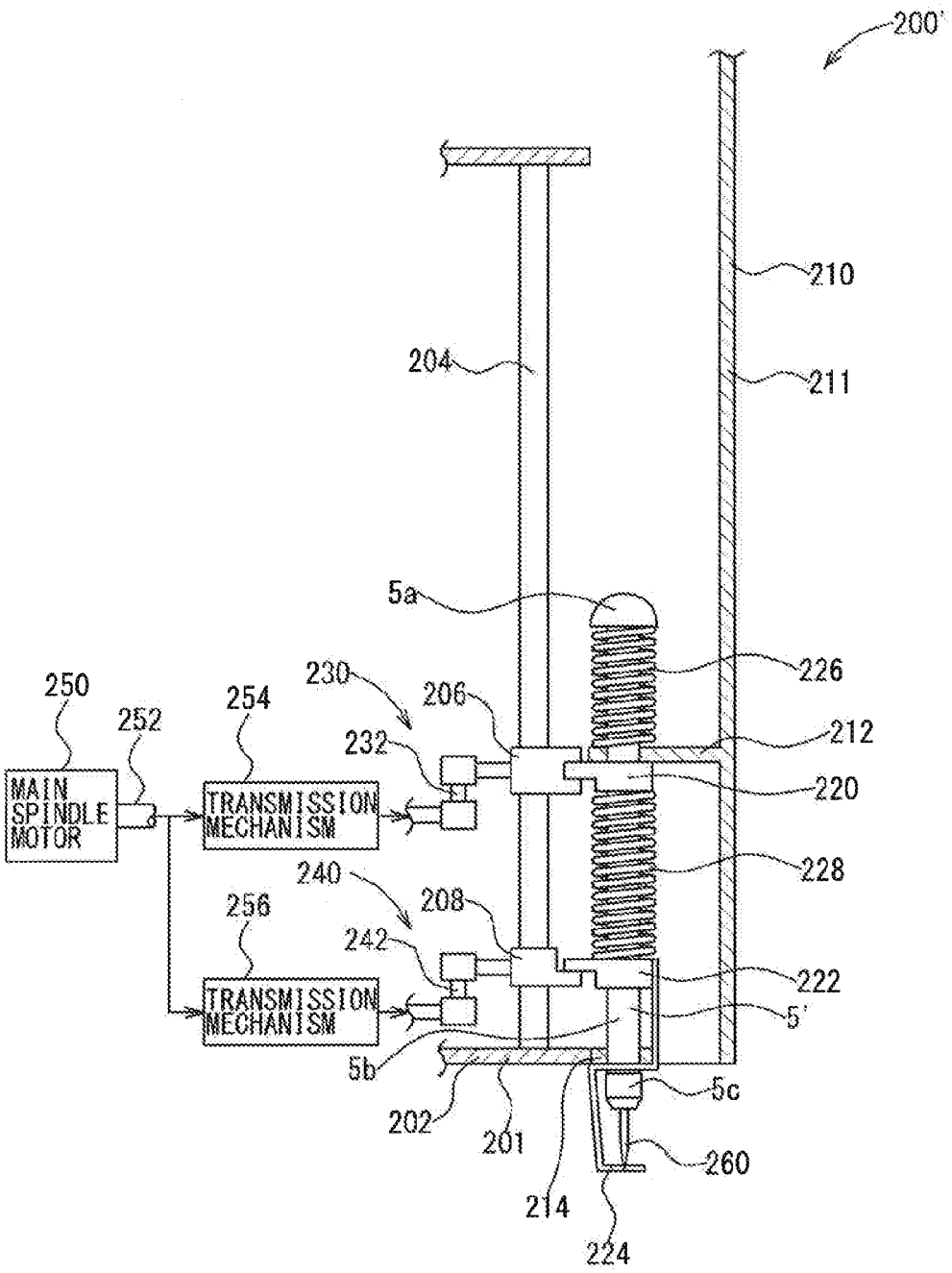
FIG. 13 is a cross-sectional view of a principal part showing a configuration of an existing embroidery sewing machine.

The vertically-movable sleeve 12 exhibits a cylindrical shape and is made from metal. As illustrated in FIG. 13, when the needle bar 5 is used, a needle bar connecting stud 220 is attached to the vertically-movable sleeve 12. An insert hole 12K formed along an axis line of the vertically-movable sleeve 12 is positioned in the vertically-movable sleeve 12. The insert hole 12K has a columnar inner circumferential surface.

The guide bush 14 assumes an approximately-cylindrical shape and includes a cylindrically-formed main body (a guide bush body) 16 and a cylindrical flange 18 that protrudes from a circumferential surface at a lower end of the main body 16. The guide bush 14 is made in one from metal (specifically stainless steel (SUS)). An outer diameter of the flange 18 is made greater than an outer diameter of the main body 16. An outer diameter of the main body 16 is made approximately equal to an inner diameter of the vertically-movable sleeve 12. The main body 16 is fixed in the vertically-movable sleeve 12 by means of press-fitting. The outer diameter of the flange 18 is made approximately equal to (or equal to) the outer diameter of the vertically-movable sleeve 12.

An insert hole 14*k* for insertion of a cam shaft 30 is formed along an axis line of the guide bush 14 is formed so as to penetrate through the guide bush 14 from its upper end to lower end. The insert hole 14K is formed in mutual communication with the insert hole 12K and assumes a columnar inner circumferential surface.

The needle bar body 10 is formed as mentioned above. A portion of the needle bar body 10 from the lower to upper ends of the guide bush 14 makes up a small-diameter portion 10-1, and a portion of the needle bar body 10 from the upper end of the guide bush 14 to the upper end of the vertically-movable sleeve 12 makes up a large-diameter portion 10-2. A diameter of an insert hole of the large-diameter portion 10-2 (i.e., a diameter of the insert hole 12K) is made larger than a diameter of an insert hole of the small-diameter portion 10-1 (i.e., a diameter of the insert hole 14K of the guide bush 14). The axis line of the vertically-movable sleeve 12 and the axis line of the guide bush 14 coincide with the axis line of the needle bar body 10. The insert hole 12K corresponds to a hole of the large-diameter portion 10-2, and the insert hole 14K corresponds to a hole of the small-diameter portion 10-2. The word "small-diameter portion" may also be referred to as a "hole small-diameter portion" or an "insert hole small-diameter portion." Further, the word "large-diameter portion" may also be referred to as a "hole large-diameter portion" or an "insert hole large-diameter portion." The word "small-diameter portion" may also be referred to as a "first constitution section," and the large-diameter portion" may also be referred to as a "second constitution section."

The sleeve 20 assumes a cylindrical shape, and openings 20*a* and 20*b* used for positioning balls 22 are formed in a lower end portion of the sleeve 20. The sleeve 20 is inserted into the vertically-movable sleeve 12 of the needle bar body 10 (at least a lower portion of the sleeve 20 is inserted into the vertically-movable sleeve 12), and the needle bar body 10 is formed so as to be slidable with respect to the sleeve 20. Specifically, an outer diameter L20 of the sleeve 20 is made so as to become equal to an inner diameter L12 of the vertically-movable sleeve 12 or less (preferably smaller than the inner diameter of the vertically-movable sleeve 12). Incidentally, in order to prevent the balls 22 from falling into clearance between the sleeve 20 and the vertically-movable sleeve 12, a half of a difference between the inner diameter of the vertically-movable sleeve 12 and the outer diameter of the sleeve 20 is made smaller than a diameter of the ball 22. Moreover, the outer diameter of the sleeve 20 is made larger than a diameter of the insert hole 14K of the small-diameter portion 10-1. The sleeve 20 is made from metal. The word "sleeve 20" may also be referred to as a "fixed sleeve 20."

The openings 20*a* and 20*b* are formed in the same size and shape. Both openings are circular openings and placed at positions where they are opposite to each other with the axis line of the sleeve 20 laid therebetween. Specifically, an imaginary straight line connecting a center of the opening 20*a* to a center of the opening 20*b* intersects the axis line of the sleeve 20 at right angle. The openings 20*a* and 20*b* are formed so as to run through the sleeve 20 from its outer circumferential surface to inner circumferential surface. Sizes of the openings 20*a* and 20*b* are made in such a way that the balls 22 can make rotations within the openings 20*a* and 20*b*, respectively. Diameters of the openings 20*a* and 20*b* are made so as to become equal to the diameters of the balls 22 or more.

A portion of the sleeve 20 protruding upward from the needle bar 10; more specifically, an upper end portion of the sleeve 20, is fixedly supported by a holder 70. Accordingly, even when the needle bar body 10 is situated at the top dead center, the sleeve 20 is made so as to protrude upward from the needle bar body 10. Though the sleeve 20 also protrudes upward from an upper end of the holder 70, the sleeve 20 can also be made so as not to protrude upward from the holder 70 by brining an upper end of the sleeve 20 in agreement with the upper end of the holder 70.

In order for the balls 22 to come out of the inner circumference of the sleeve 20 and subsequently into engagement with grooves 36*a* and 36*b*, a thickness L1 (in other words, a difference between the outer diameter and the inner diameter of the sleeve 20) of a tube making up the sleeve 20 is made smaller than the diameter of the balls 22.

The balls 22 are provided in the opening 20*a* and the opening 20*b* of the sleeve 20, respectively. One of the pair of balls 22 engages with the groove 36*a*, whilst the other ball engages with the groove 36*b*. The balls 22 assume a spherical shape. Although the balls are specifically made from a chrome ball, they can also be made from another steel ball like a carbon ball or a material like stainless steel or ceramic. The opening 20*a* is one of the openings, and the opening 20*b* is the other opening. The groove 36*a* is one of the grooves, and the groove 36*b* is the other groove.

The cam shaft 30 has a disc-shaped portion 32, an upper shaft 34 extending upward from an upper surface of the disc-shaped portion 32, and a lower shaft 38 extending downward from a lower surface of the disc-shaped portion 32. The entirety of the cam shaft 30 is made in one from metal (to be more specific, stainless steel (SUS)).

The disc-shaped portion 32 assumes a disc-like shape (or can also assume a columnar shape). An outer diameter L32 (a "diameter" can also be adopted) of the disc-shaped portion 32 is set to a length which is equal to or less than an inner diameter of the vertically-movable sleeve 12 (preferably a length smaller than the inner diameter of the vertically-movable sleeve 12) such that the disc-shaped portion 32 is rotatable within the vertically-movable sleeve 12. The outer diameter L32 is also set to a length that is larger than an inner diameter of the guide bush 14 (i.e., a diameter of an insert hole of the small-diameter portion 10-1). The disc-shaped portion 32 is placed within the vertically-movable sleeve 12 and on an upper surface of the guide bush 14.

The upper shaft 34 assumes a spindle shape, and a pair of grooves 36*a*, 36*b* are formed in a circumferential surface of the upper shaft 34. Specifically, the groove 36*a* and the groove 36*b* are placed at mutually-opposed positions with an axis line of the cam shaft 30 laid therebetween. The groove 36*a* and the groove 36*b* are formed so as to become symmetrical about a point with the axis line of the cam shaft 30 laid therebetween. The upper shaft 34 has a configuration in which the pair of grooves 36*a*, 36*b* are formed in a columnar shaft-shaped member.

Each of the grooves 36*a*, 36*b* has an upper-side straight portion continually followed by a lower helical portion. For instance, the groove 36*a* has a straight portion 36*a*-1 and a helical portion 36*a*-2, and the groove 36*b* has a straight portion 36*b*-1 and a helical portion 36*b*-2. The straight portions 36*a*-1 and 36*b*-1 are straight grooves parallel to the axis line of the cam shaft 30. Each of the helical portions 36*a*-2 and 36*b*-2 has a rotation angle of about 120 degrees (or exactly 120 degrees) from its upper end to lower end. For instance, a center position 36P of the groove on the upper end of the helical portion 36*a*-2 corresponds to a position on a lower end of the helical portion 36*a*-2 that is rotated about 120 degrees with respect to the center position on the upper end. The helical portion 36*a*-2 and the helical portion 36*b*-2 make up helical grooves. In short, reference symbol a in FIG. 7 assumes a value of about 120 degrees.

The helical portions 36*a*-2 and 36*b*-2 are formed in a direction in which the cam shaft 30 has counterclockwise rotation when viewed from above in the course of the needle bar 5 shifting from the bottom dead center to the top dead center. Specifically, the helical portions 36*a*-2 and 36*b*-2 are formed clockwise in a circumferential surface of the upper shaft 34. Namely, the helical portions 36*a*-2 and 36*b*-2 are formed as a clockwise helical pattern (or a right-handed helical pattern). As a result, the sewing needle 60 rotates counterclockwise when viewed from above in a course of the needle bar 5 shifting from the bottom dead center to the top dead center. In the course of the needle bar 5 shifting from the top dead center to the bottom dead center, the sewing needle 60 rotates clockwise when viewed from above.

The groove 36*a* is formed to a depth such that the ball 22 comes into engagement with the groove 36*a* while placed within the opening 20*a*. Likewise, the groove 36*b* is formed to a depth such that the ball 22 comes into engagement with the groove 36*b* while placed within the opening 20*b*.

A groove used for engagement with a ring 40 is formed in an outer circumferential surface of an upper end of the upper shaft 34, and the ring 40 is formed in the groove. When the balls 22 have dropped off from the openings 20*a* and 20*b*, the ring 40 prevents the balls 22 from further falling off from the upper end of the cam shaft 30.

Upper ends of the grooves 36*a*, 36*b* are formed up to a neighborhood of an upper end of the upper shaft 34, and lower ends of the grooves 36*a*, 36*b* are formed up to a neighborhood of a lower end of the upper shaft 34.

The upper shaft 34 is inserted into the sleeve 20 from below. The balls 22 are placed within the openings 20*a*, 20*b* and in engagement with the grooves 36*a*, 36*b*. Naturally, an outer diameter L34 ("diameter") of the upper shaft 34 (in other words, a length of a distance between mutually-opposed areas in the outer circumferential surface of the upper shaft 34 where the grooves are not formed) is set to a length that enables the upper shaft 34 to make rotations with respect to the sleeve 20. Specifically, the outer diameter of the upper shaft 34 is set to a length that is equal to or less than the inner diameter of the sleeve 20 (preferably a length smaller than the inner diameter of the sleeve 20). Further, the outer diameter L34 of the upper shaft 34 and the inner diameter of the sleeve 20 are set in such a way that the balls 22 do not fall into clearance between the sleeve 20 and the upper shaft 34. Specifically, a value of a half of a difference between the inner diameter of the sleeve 20 and the outer diameter L34 of the upper shaft 34 is set so as to become smaller than the diameter of the ball 22.

The lower shaft 38 assumes a spindle shape (specifically a columnar shape) and is formed to a length that enables the lower shaft 38 to be inserted into the guide bush 14 and further into the joint 50. A diameter of the lower shaft 38 is set to a length that is equal to or smaller than the insert hole 14K of the guide bush 14 (preferably a length smaller than the insert hole 14K of the guide bush 14) so that the lower shaft 38 can make rotations with respect to the guide bush 14. The diameter of the lower shaft 38 is also set to a size that enables a joint body 52 to be inserted into an insert hole 52K.

An axis line of the disc-shaped portion 32, an axis line of the upper shaft 34, and an axis line of the lower shaft 38 are determined so as to come into alignment with each other.

The cam shaft 30 has an axis-like shaft body and a cylindrical-shaped cylindrical portion placed at an arbitrary location between an upper end and a lower end of the shaft body. The cam shaft 30 is formed in one in its entirety. The shaft body can also be said to include an upper shaft that is an upper-side portion of the shaft body with reference to the cylindrical portion, a lower shaft that is a lower-side portion of the shaft body with reference to the cylindrical portion, and an interior of the cylindrical portion.

The joint 50 assumes an approximately-cylindrical shape. The joint 50 includes a cylindrical joint body 52 having a chamfered lower end, a screw (a first screw) 54 screw-engaged with a threaded hole 52*a* of the joint body 52, and a screw (a second screw) 56 screw-engaged with a threaded hole 52*b* of the joint body 52. The joint 50 is made in one from metal (specifically stainless steel (SUS)).

Specifically, the insert hole 52K running through the joint body 52 from its upper end to lower end is laid along an axis line of the joint 50. The lower shaft 38 of the cam shaft 30 and the sewing needle 60 can be inserted into the insert hole 52K. Specifically, the lower shaft 38 is inserted into the joint body 52 from its upper side, and the sewing needle 60 is inserted into the joint body 52 from its lower side. A threaded hole 52*a* for screw-engagement with the screw 54 used in order to secure the cam shaft 30 and a thread hole 52*b* for screw-engagement with the screw 56 used in order to secure the sewing needle 60 are formed in a side surface of the joint body 52 so as to penetrate through the joint body 52 from its outer circumferential surface to inner circumferential surface. In other words, the threaded holes 52*a*, 52*b* are formed between the outer circumferential surface of the joint 50 and the insert hole 52K. The threaded hole 52*a* is provided higher than is the threaded hole 52*b*. The insert hole 52K is a hole for insertion of the sewing needle 60 as well as the lower shaft 38. The threaded hole 52*a* is a threaded hole for securing the lower shaft, and the threaded hole 52*b* is a threaded hole for securing a sewing needle.

The screw 54 is screw-engaged with the threaded hole 52*a*, and the screw 56 is screw-engaged with the threaded hole 52*b*. The screw 54 and the screw 56 are of the same configuration. The screw 54 is screw-engaged with the threaded hole 52*a* with the lower shaft 38 inserted in the insert hole 52K, and the lower shaft 38 is pressed by a leading edge of the screw 54, thereby securing the lower shaft 38. In other words, the screw 54 works as securing means for securing the lower shaft 38 to the joint 50. Moreover, the screw 56 is screw-engaged with the threaded hole 52*b* with the sewing needle 60 inserted in the insert hole 52K, and the sewing needle 60 is pressed by a leading edge of the screw 56, thereby securing the sewing needle 60. In other words, the screw 56 works as securing means for securing the sewing needle 60 to the joint 50. The joint 50 can be said to be a connection section for connecting the lower shaft 38 to the sewing needle 60.

In a state where the cam shaft 30 is secured to the joint 50, the guide bush 14 is sandwiched between the joint 50 and the disc-shaped portion 32, and an upper surface of the joint body 52 remains in contact with a lower surface of the guide bush 14. Even when making rotations, the joint 50 rotates while the upper surface of the joint body 52 remains in contact with the lower surface of the guide bush 14.

An outer diameter of the joint body 52 is approximately equal (or exactly equal) to an outer diameter of the guide bush 14 with each other. The vertically-movable sleeve 12, the guide bush 14, and the joint 50 are formed so as to have an approximately equal outer diameter (can also have exactly an equal diameter). An outer circumferential surface of structure made up of the needle bar body 10 and the joint 50 forms one columnar circumferential surface except the chamfered lower end of the joint 50, and are flush with each other.

The sewing needle 60 is inserted into the insert hole 52K of the joint body 52 and secured by the screw 56. Thus, the sewing needle 60 is provided while projecting downward with reference to a lower surface of the joint body 52. The sewing needle 60 is secured to the joint 50 of the needle bar 5, thereby making up a needle bar unit. Namely, the needle bar unit is made up of the needle bar 5 and the sewing needle 60.

As above, the cam shaft 30 is secured to the joint 50, and the sewing needle 60 is secured to the joint 50. Accordingly, in the state where the sewing needle 60 is secured to the joint 50, the cam shaft 30, the joint 50, and the sewing needle 60 are formed in one (a rotation unit 65 is made up of the cam shaft 30, the joint 50, and the sewing needle 60), and the rotation unit 65 makes rotations with respect to the needle bar body 10 and the sleeve 20.

Figure 3:
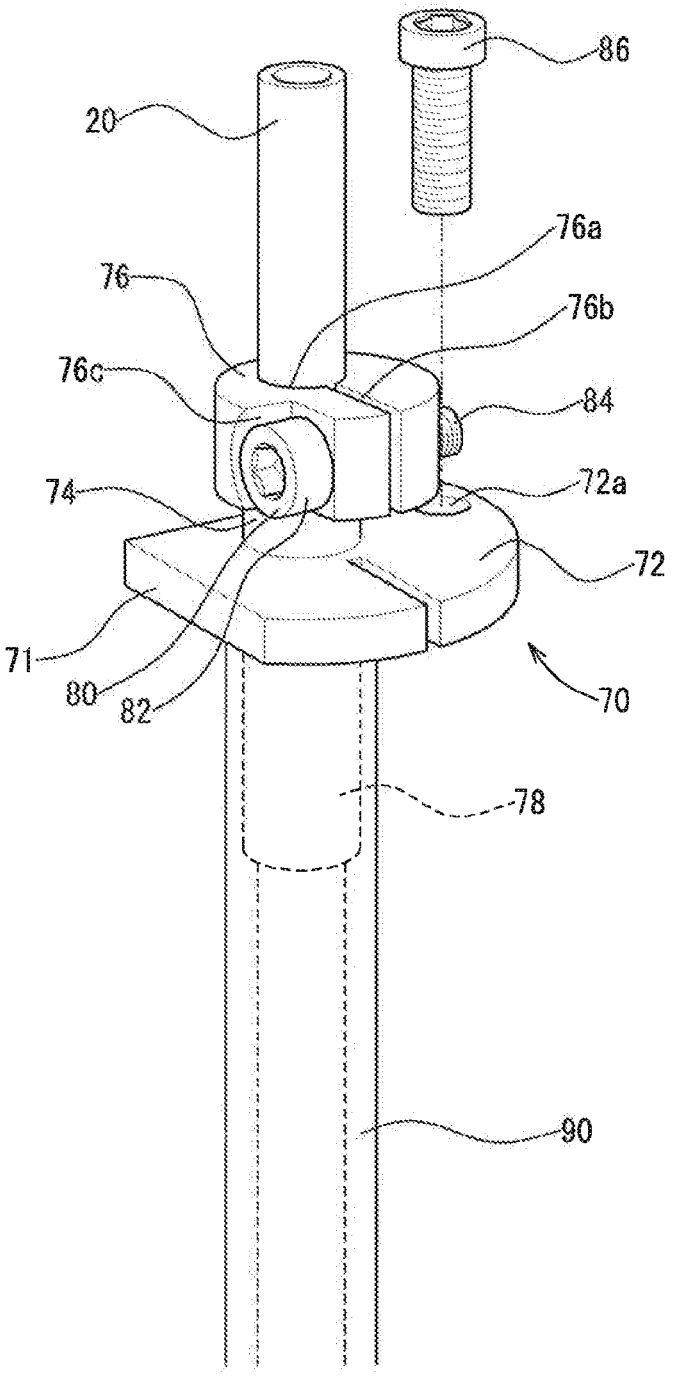
FIG. 3 is a perspective view of a principal part of the needle bar (the first example)
Figure 4:
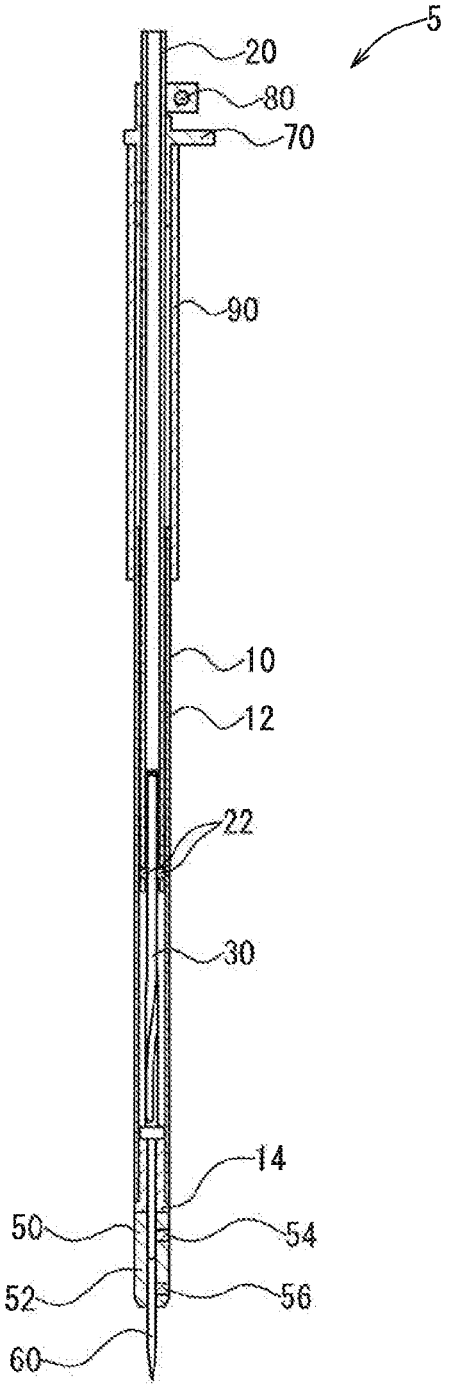
FIG. 4 is a longitudinal cross-sectional view of the needle bar (the first example)
Figure 5:
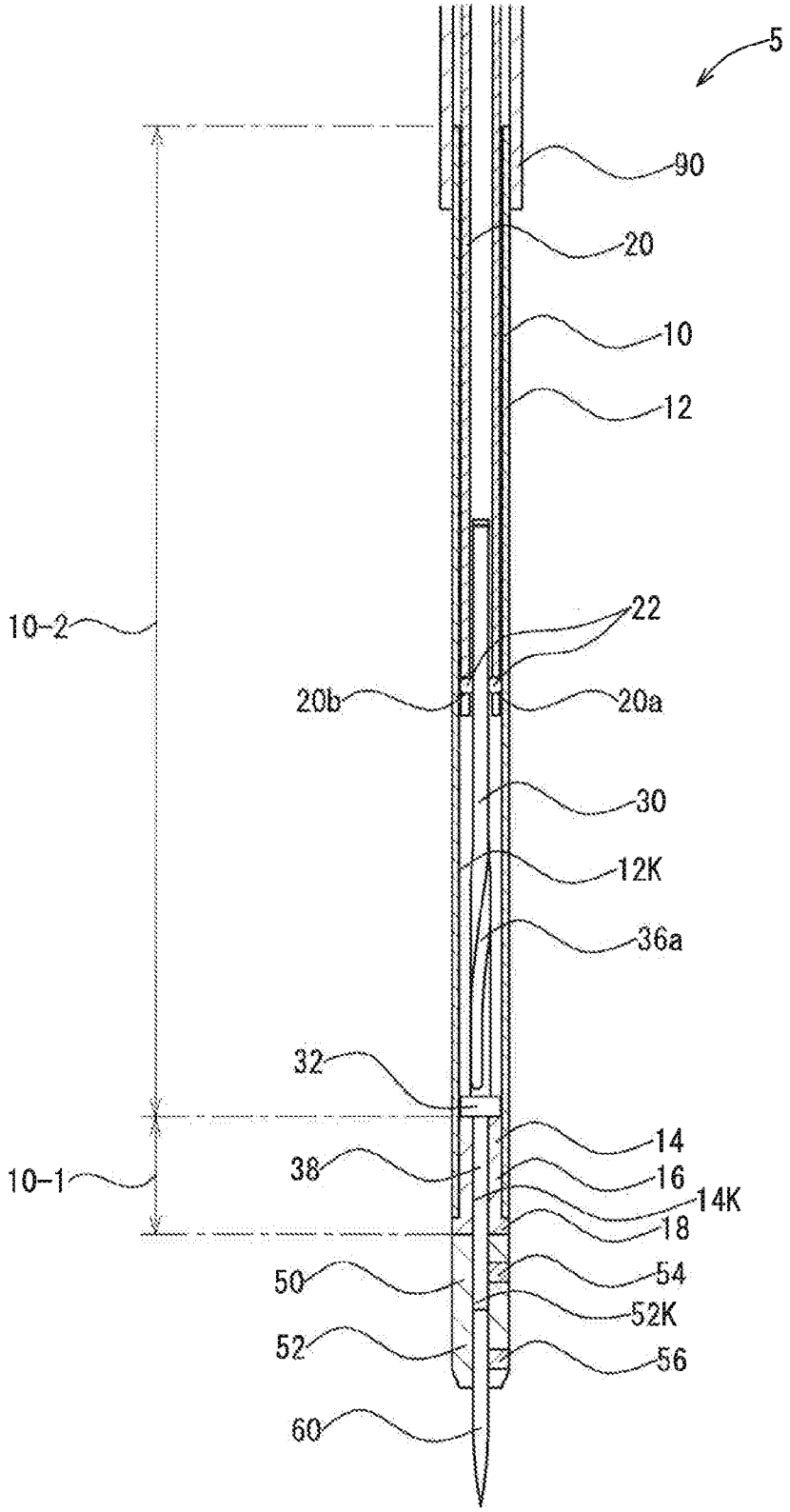
FIG. 5 is an enlarged view of the principal part illustrated in FIG. 4 (the first example)
Figure 6:
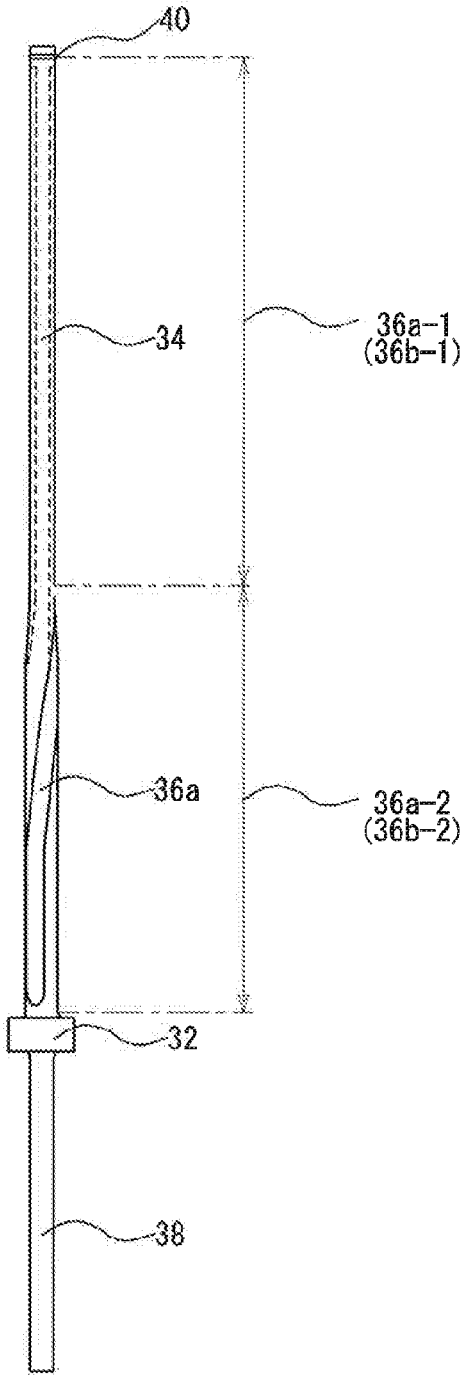
FIG. 6 is a front view of a cam shaft (the first example)
Figure 7:
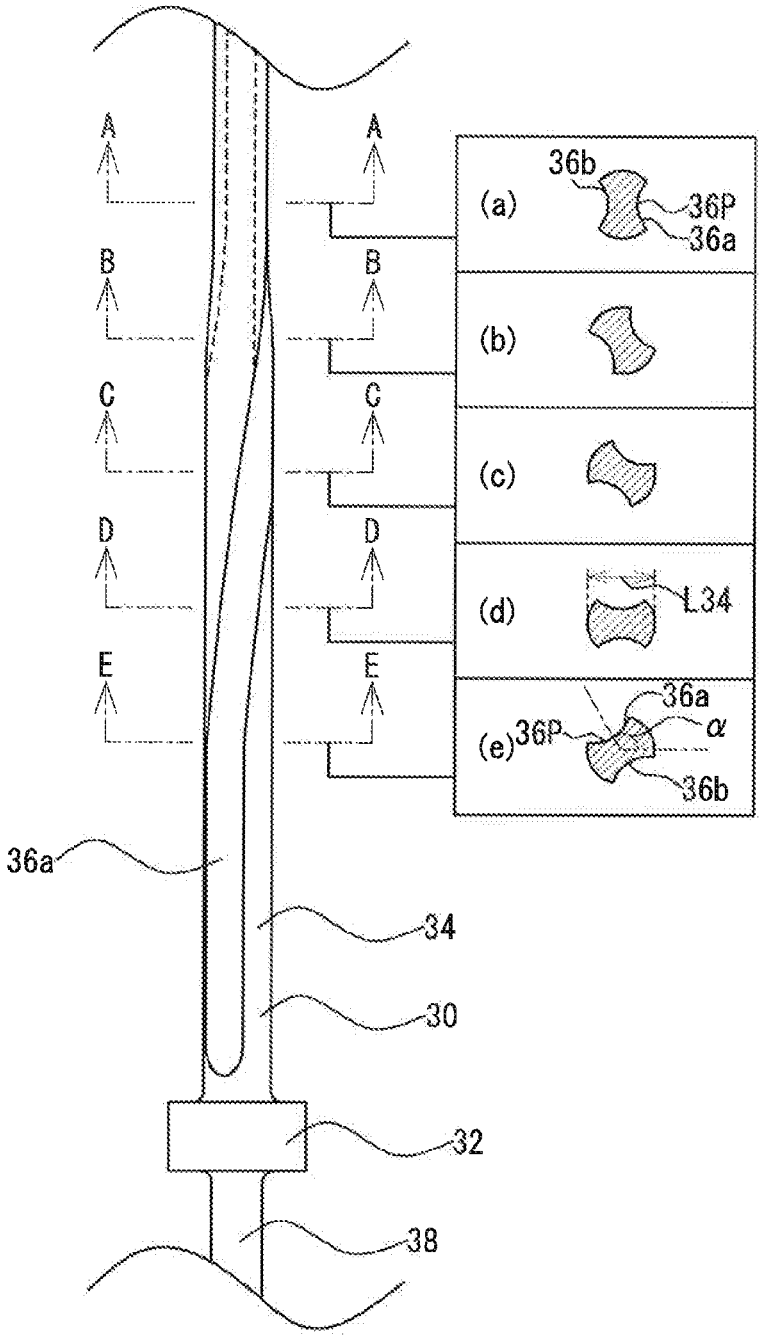
FIG. 7 is an enlarged view of a principal part of the cam shaft, wherein (a) is an end elevation view taken along A-A, wherein (b) is an end elevation view taken along B-B, wherein (c) is an end elevation view taken along C-C, wherein (d) is an end elevation view taken along D-D, and wherein (e) is an end elevation view taken along E-E (the first example)

The holder 70 is a member for securing other members (e.g., members making up a housing of the sewing machine) and also securing the needle bar 5. As illustrated in FIG. 3, the holder 70 has a holder body 71 and a bolt 80 screw-engaged with the holder body 71. The holder body 71 is made of a synthetic resin.

The holder body 71 has a plate 72, a tubular portion 74 formed on an upper surface of the plate 72 so as to protrude upward, a fixed portion 76 continually followed by an upper end of the tubular portion 74, and a tubular portion 78 formed on a lower surface of the plate 72 so as to protrude downward.

The plate 72 assumes a shape of a flat plate and has an insert hole for insertion of the sleeve 20 (an insert hole (see FIG. 4) connected in communication with the insert hole of the tubular portion 74 and an insert hole of a tubular portion 78) and a hole 72*a* for insertion of a screw used to secure the plate to another member.

The tubular portion 74 assumes a cylindrical shape and has an insert hole whose inner diameter permits insertion of the sleeve 20. Specifically, the inner diameter of the tubular portion 74 is set to a length that is equal to or slightly larger than an outer diameter of the sleeve 20.

The fixed portion 76 assumes an approximately-cylindrical shape and has an insert hole 76*a* for insertion of the sleeve 20, a slit 76*b* continually extending from the insert hole 76*a*, a cutout 76*c* where a head 82 of a bolt 80 is to be situated; and a threaded hole 76*d* for screw-engagement of an axis portion 84 of the bolt 80.

The tubular portion 78 assumes a cylindrical shape and has an inner diameter which permits insertion of the sleeve 20. Specifically, the inner diameter of the tubular portion 78 is set to a length that is equal to or slightly larger than an outer diameter of the sleeve 20.

The bolt 80 has an axis portion 84 with a threaded circumferential surface and the head 82 provided at an end of the axis portion 84.

As above, the insert hole 76*a* of the fixed portion 76, the insert hole of the tubular portion 74, the insert hole of the plate 72, and the insert hole of the tubular portion 78 are aligned in the holder 70, whereby an insert hole for insertion of the sleeve 20 is created within the holder 70 from its upper end to lower end.

In the holder 70, the sleeve 20 is fixedly secured to the holder 70 by fastening the bolt 80 while the sleeve 20 remains inserted in the insert hole. Further, the plate 72 is attached to another member by inserting the screw (fixing means or a fixture) 86 into the hole 72*a*, whereby the holder 70 is fastened to the another member. In this regard, another fixing means (for instance, a bolt and a nut) may also be used in place of the screw 86.

The cover 90 assumes a cylindrical shape, and an inner circumferential surface is fixed to an outer circumferential surface of the tubular portion 78 of the holder 70 by means of press-fitting or the like. The cover 90 is made from metal. A length of the cover 90 along a direction of its axis line is set to a length that enables the cover 90 to cover an upper end portion of the needle bar body 10. Specifically, the length is set to a length that enables the cover 90 to cover the an area up to an upper end portion of the vertically-movable sleeve 12 when the needle bar body 10 is situated at a bottom dead center. Namely, the cover 90 sheathes a portion of the needle bar body 10 exposed at the sleeve 20, so as to prevent intrusion of contaminants, like dust, into clearance between the needle bar body 10 and the sleeve 20. An inner diameter of the cover 90 is set to a length that is equal to or more than the outer diameter of the vertically-movable sleeve 12 (preferably a length larger than the outer diameter of the vertically-movable sleeve 12). The inner diameter of the cover 90 is approximately equal to an outer diameter of the tubular portion 78 of the holder 70.

In the needle bar 5 having the above configuration, the needle bar body 10 is vertically moved while the sewing needle 60 is fixed to the joint 50 and while the holder 70 is fixed to another member, whereby the rotation unit 65; namely, the cam shaft 30, the joint 50, and the sewing needle 60 make rotations. Specifically, since the balls 22 disposed in the openings 20*a*, 20*b* of the sleeve 20 are in engagement with the grooves 36*a*, 26*b*, changes occur in relative positions of the balls 22 in the grooves 36*a*, 36*b* as a result of vertical movement of the needle bar body 10, whereupon the cam shaft 30 makes rotations. The joint 50 and the sewing needle 60 are rotated as a result of rotation of the cam shaft 30. The needle bar body 10 is vertically moved but not rotated. Since an outer diameter of the disc-shaped portion 32 of the cam shaft 30 is larger than the inner diameter of the guide bush 14 (the inner diameter of the insert hole 14K), the cam shaft 30 will not downwardly fall off from the needle bar body 10. Moreover, since the cam shaft 30 is fixed to the joint 50, the cam shaft 30 will not upwardly come off from the needle bar body 10.

As above, the needle bar 5 itself assumes in its entirety an approximately-columnar shape. With the exception of the holder 70 and the cover 90 provided on the needle bar 5, the needle bar 5 assumes an appearance similar to an ordinary needle bar.

In the needle bar 5, the needle bar body 10, the sleeve 20, the cam shaft 30, the joint 50, and the cover 90 are formed such that their axes (center lines) are in alignment with each other.

Figure 8:
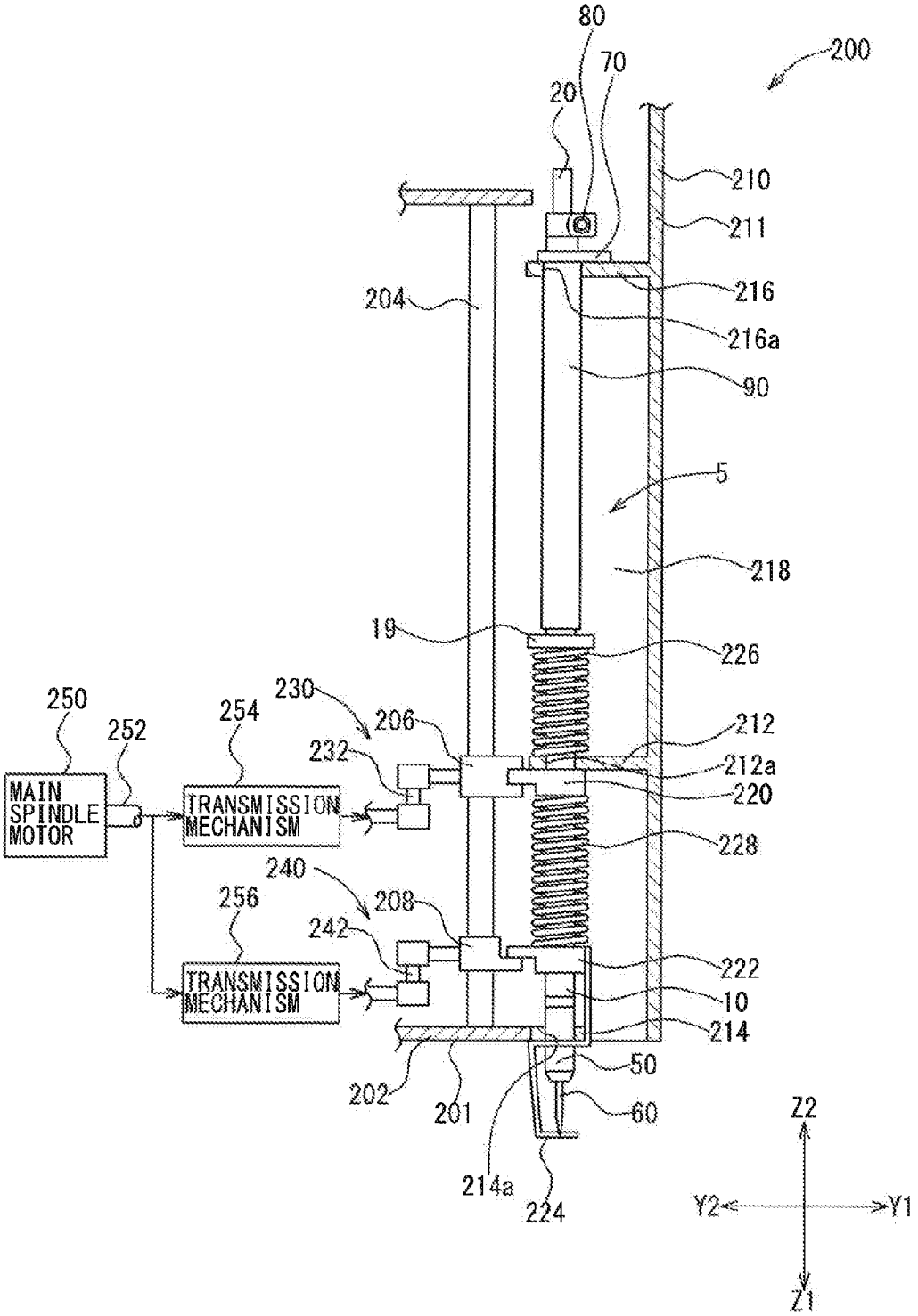
FIG. 8 is a cross-sectional view of the principal part acquired when the needle bar of the first example is applied to an embroidery sewing machine.

A state of specific use of the needle bar 5 having the configured mentioned above is now described. An example of a case where the needle bar 5 is applied to an embroidery sewing machine is first described. As illustrated in FIG. 8, in an embroidery sewing machine 200 (hereinafter referred to simply as a "sewing machine 200"), a needle bar case 210 is formed so as to be slidable with respect to the arm 201 in a horizontal direction (a front-back direction in FIG. 8 (a direction orthogonal to a Y1-Y2 direction and a Z1-Z2 direction)). The needle bar case 210 is provided with a plurality of needle bars 5. Specifically, the plurality of needle bars 5 are disposed at intervals in the horizontal direction within the needle bar case 210.

The needle bar 5 is inserted into supports 212 and 214 of the needle bar case 210 and supported by a support 216 in the needle bar case 210. The supports 212, 214, and 216 make up part of the needle bar case 210. All of the supports 212, 214, and 216 are made so as to extend in the horizontal direction and interposed between a right lateral portion 218 of the needle bar 210 and a left lateral portion on the other side of the right lateral portion 218. The supports 212 and 216 continually extend from a front portion 211.

A hole 212*a* for insertion of the needle bar 5 (especially the needle bar body 10) is opened in the support 212. A hole 214*a* for insertion of the needle bar 5 (particularly the joint 50 and the needle bar body 10) is opened in the support 214. The needle bar 5 is accordingly inserted into the holes. A hole 216*a* for insertion of the needle bar 5 (to be specific, the cover 90) and a threaded hole 216*b* for screw-engagement of the screw 86 are also opened in the support 216. The holder 70 is secured to the support 216 by inserting the cover 90 into the hole 216*a* and screw-engaging the screw 86 with the threaded hole 216*b*. In this respect, the sleeve 20 is secured to the holder 70. Specifically, the support 216 corresponds to a support member for fixedly supporting the holder 70 with the screw (securing means) 86.

The needle bar body 10 (particularly the vertically-movable sleeve 12) is fixedly equipped with the needle bar connecting stud 220. Namely, the needle bar connecting stud 220 is secured to the needle bar body 10 while the needle bar body 10 remains inserted in the needle bar connecting stud 220. A presser foot connecting stud 222 is placed below the needle bar connecting stud 220. More specifically, the needle bar body 10 or the joint 50 is inserted into the presser hoot holder 222. A presser foot 224 is attached to the presser foot connecting stud 222.

A ring-shaped fixing member 19 used for placing a needle bar holding spring 226 is fixedly disposed at a position above the support 212 in the needle bar body 10. Specifically, FIG. 8 is a drawing of the needle bar 5 situated at the top dead center. When the needle bar 5 stays at the top dead center, the fixing member 19 is placed at a position which is lower than a lower end of the cover 90 in the needle bar body 10.

The needle bar holding spring 226 is interposed between the fixing member 19 and the support 212. The needle bar holding spring 226 is a coiled spring, and the needle bar body 10 remains inserted in the needle bar holding spring 226. An upper end of the needle bar holding spring 226 stays in contact with the fixing member 19, thereby regulating upward extension of the needle bar holding spring 19. A lower end of the needle bar holding spring 226 stays in contact with the support 212, thereby regulating downward extension of the needle bar holding spring 226.

A presser foot spring 228 is interposed between the needle bar connecting stud 220 and the presser foot connecting stud 222. The presser foot spring 228 is a coiled spring, and the needle bar body 10 or the joint 50 remains inserted in the presser foot spring 228. An upper end of the presser foot spring 228 stays in contact with the needle bar connecting stud 220, thereby regulating upward extension of the presser foot spring 228. A lower end of the presser foot spring 228 stays in contact with the presser hood holder 222, thereby regulating downward extension of the presser foot spring 228.

A needle bar base 204 stands upright on the arm 201. A needle bar up/down component 206 (which can also be referred to as a needle bar vertically-movable component or a needle bar elevation element) which is to engage with the needle bar connecting stud 220 and a presser foot up/down component 208 (which can also be referred to as a presser foot vertically-movable component or a presser foot elevation element) which is to engage with the presser foot connecting stud 222 are provided in a vertically movable manner along the needle bar base 204.

In the configuration illustrated in FIG. 8, the needle bar case 210 horizontally slides with respect to the arm 201. The needle bar up/down component 206 thereupon comes into engagement with the needle bar connecting stud 220 placed on a predetermined needle bar 5 among the plurality of needle bars 5. The presser foot up/down component 208 then comes into engagement with the presser foot connecting stud 222 placed on the predetermined needle bar 5 among the plurality of needle bars 5.

The needle bar up/down component 206 is vertically moved by use of a mechanism for vertically moving the needle bar up/down component 206. This induces vertical movement of the needle bar connecting stud 220 and also vertical movement of the needle bar 5. A vertical movement mechanism 230 for vertically moving the needle bar up/down component 206 includes a crank rod 232 for vertically moving the needle bar up/down component 206, a main spindle motor 250 for rotating a main spindle 252, and a transmission mechanism 254 for transmitting torque of the main spindle 252 to the crank rod 232. For instance, a cam mechanism is mentioned as the transmission mechanism 254. The needle bar up/down component 206 corresponds to a needle bar connecting stud up/down mechanism (which may also be referred to as a "needle bar connecting stud vertically-movable mechanism," and the same applies to any counterparts throughout the descriptions) for vertically moving the needle bar connecting stud. Further, the crank rod 232, the transmission mechanism 254, the main spindle motor 250, and the main spindle 252 also correspond to the needle bar connecting stud up/down mechanism.

Compared with the existing example illustrated in FIG. 13, a configuration of the sewing machine 200 illustrated in FIG. 8 (except the needle bar) is identical with the configuration of the existing example illustrated in FIG. 13 except that the support 216 for fixing the needle bar 5 at the upper end is provided. Specifically, in the existing sewing machine 200', the needle bar 5' is inserted into the supports 212, 214 of the needle bar case 210 and the presser foot connecting stud 222 so as to be vertically movable, and is secured to the needle bar connecting stud 220 while remaining inserted in the needle bar connecting stud 220. The screw 5*a* for pressing the upper end of the needle bar holding spring 226 is provided on an upper end of the needle bar 5', and the needle bar holding spring 226 is interposed between the screw 5*a* and the support 212. Further, the presser foot spring 228 is interposed between the needle bar connecting stud 220 and the presser foot connecting stud 222. The needle bar up/down component 206 comes into engagement with the needle bar connecting stud 220, and the presser foot up/down component 208 comes into engagement with the presser foot connecting stud 222. The needle bar 5' illustrated in FIG. 13 has a structure in which a needle connecting stud 5*c* is provided at a lower end of the tubular needle bar body 5*b*. A sewing needle 260 is attached to the needle connecting stud 5*c*, and the screw 5*a* is provided at an upper end of the needle bar body 5*b*.

Operation of the sewing machine 200 is now described. The needle bar up/down component 206 descends from the top dead center of the needle bar 5 illustrated in FIG. 8, FIG. 11(*b*), and FIG. 12(*b*), and the needle bar connecting stud 220 also descends, whereupon the needle bar body 10 secured to the needle bar connecting stud 220 moves down. Since the position of the balls remains unchanged (in both the vertical direction and the direction of rotation) because the sleeve 20 is secured, the relative positions of the balls 22 in the grooves 36*a*, 36*b* thereupon change. Since the grooves 36*a*, 36*b* are formed in the direction of clockwise rotation, the cam shaft 30 makes clockwise rotation when viewed from above. As a result of the cam shaft 30 making clockwise rotation, the joint 50 and the sewing needle 60 also make clockwise rotation when viewed from above. In short, the sewing needle 60 descends while making clockwise rotation.

The needle bar connecting stud 220 pushes the presser foot spring 228 from above when descending, so that the presser foot connecting stud 222 also moves downward. The presser foot up/down component 208 also descends along with downward movement of the presser foot connecting stud 222. Even after the presser foot connecting stud 222 has come into contact with the support 214, the needle bar connecting stud 220 keeps descending, whereupon the needle bar body 10 keeps descending.

Figure 11:
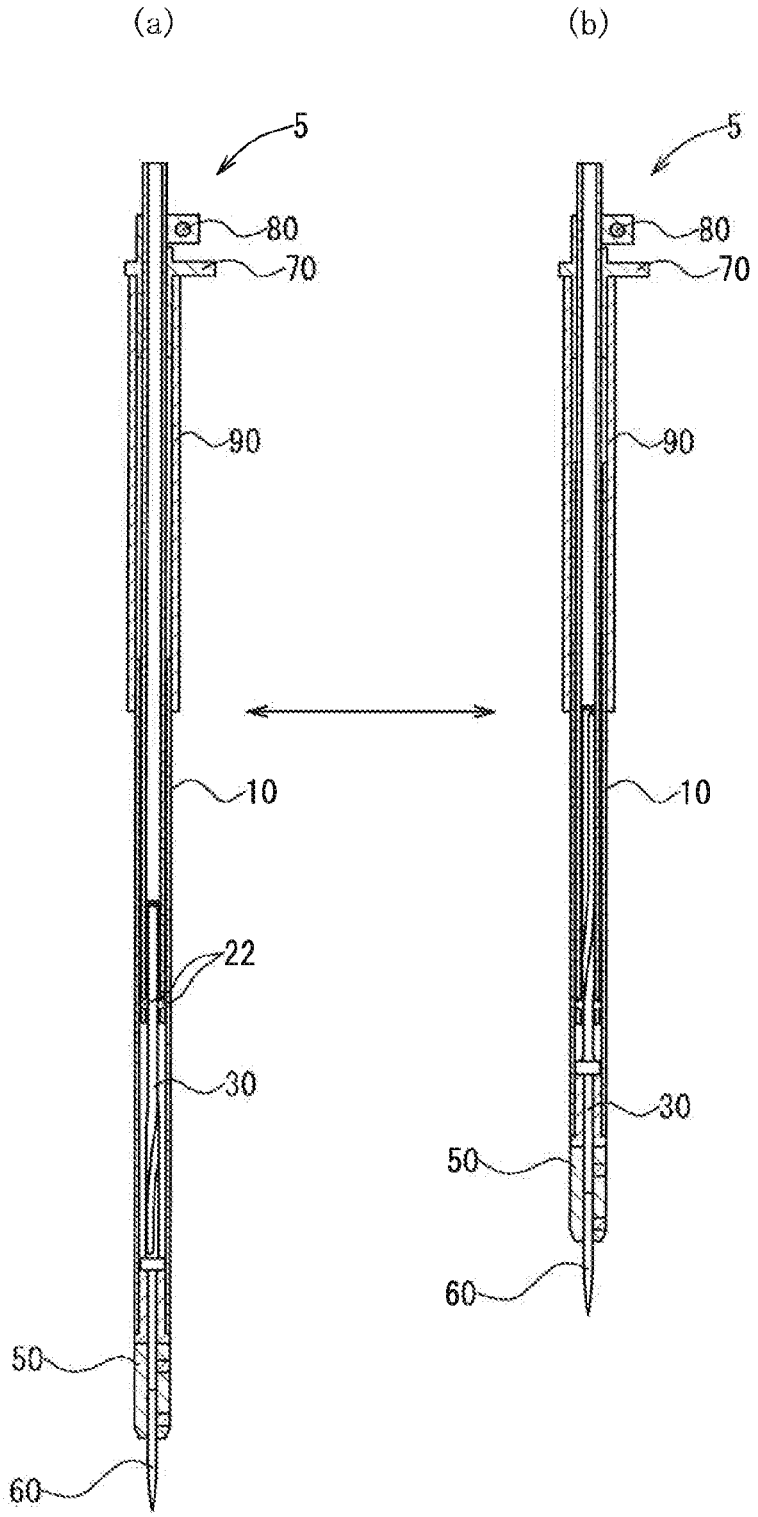
FIG. 11 is a longitudinal cross-sectional view for describing operation of the needle bar, wherein (a) is a longitudinal cross-sectional view acquired when the needle bar is situated at a bottom dead center and wherein (b) is a longitudinal cross-sectional view acquired when the needle bar is situated at a top dead center (the first example)
Figure 12:
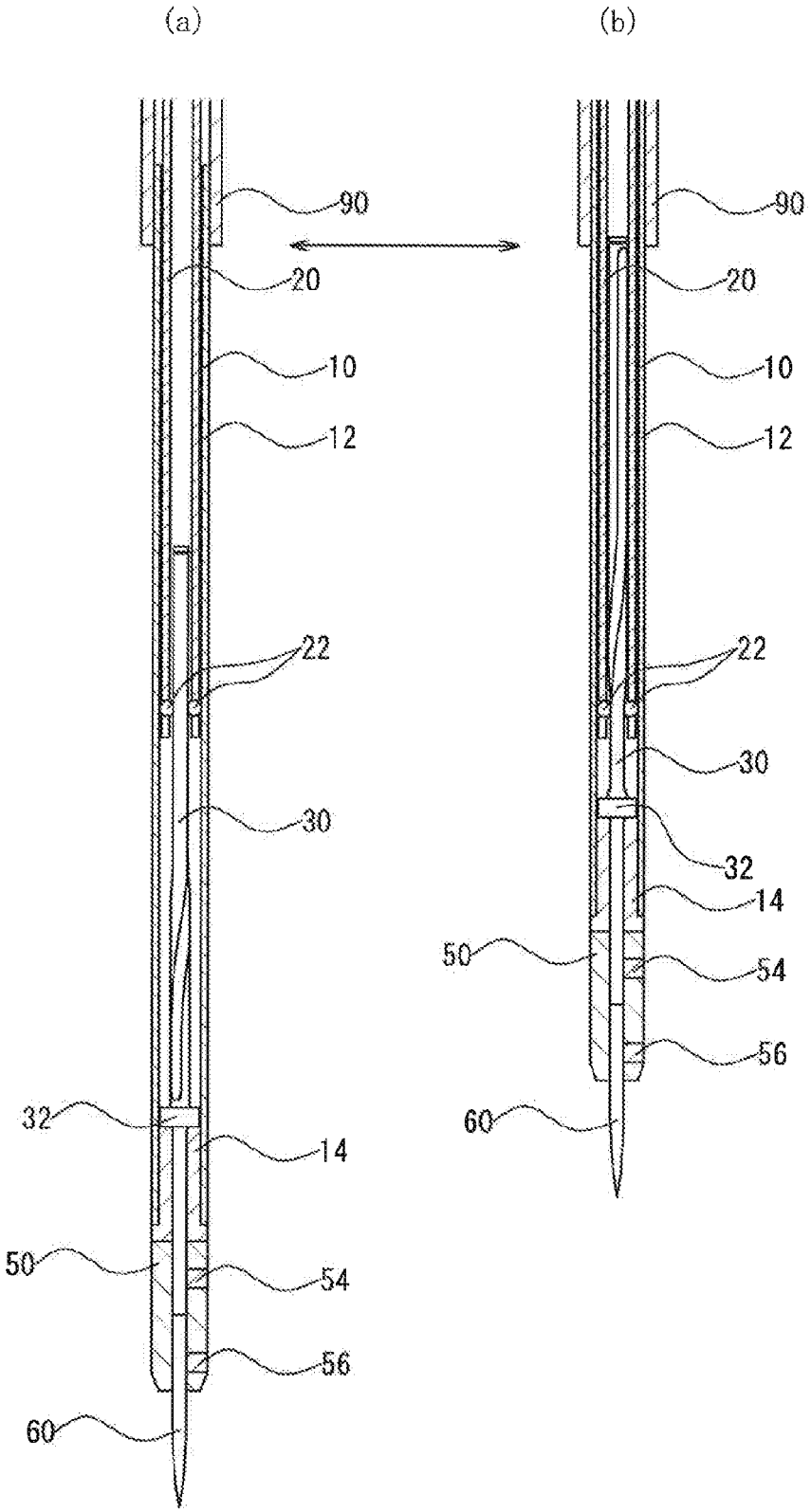
FIG. 12 is an enlarged view of a principal part illustrated in FIG. 11.

Even at the bottom dead center illustrated in FIG. 11(*a*) and FIG. 12(*a*), a lower portion of the sleeve 20 is inserted into the needle bar body 10, and an upper portion of the upper shaft 34 remains inserted in the sleeve 20.

When the needle bar connecting stud 220 ascends as a result of the needle bar up/down component 206 moving upward from the bottom dead center of the needle bar 5 illustrated in FIG. 11(*a*) and FIG. 12(*a*), the needle bar body 10 secured to the needle bar connecting stud 220 ascends. Changes thereupon occur in the relative positions of the balls 22 in the grooves 36*a* and 36*b*. Since the grooves 36*a* and 36*b* are formed in a clockwise direction, the cam shaft 30 rotates counterclockwise when viewed from above. As a result of counterclockwise rotation of the cam shaft 30, the joint 50 and the sewing needle 60 also rotate counterclockwise when viewed from above. In short, the sewing needle 60 ascends while rotating counterclockwise.

When the needle bar up/down component 206 ascends, the presser foot up/down component 208 is also elevated, whereby the presser foot connecting stud 222 and the presser foot 224 also ascend. An elevation mechanism 240 serving as a mechanism for elevating the presser foot up/down component 208 has a crank rod 242 for elevating the presser foot up/down component 208, a main spindle motor 250 for rotating a main spindle 252, and a transmission mechanism 256 for transmitting torque of the main spindle 250 to the crank rod 242. A can mechanism; for instance, can be mentioned as the transmission mechanism 256.

The rotation unit 65 rotates along with vertical movement of the needle bar 5 (in a narrow sense, the configuration except the sleeve 20 and the cover 90), so that occurrence of a hitch stitch can be prevented. In particular, when the needle bar 5 shifts from the bottom dead center to the top dead center, the sewing needle 60 performs counterclockwise rotation 120 degrees when viewed from above. When the needle bar 5 shifts from the top dead center to the bottom dead center, the sewing needle 60 performs clockwise rotation 120 degrees from above. Accordingly, occurrence of a hitch stitch can be prevented.

Figure 25:
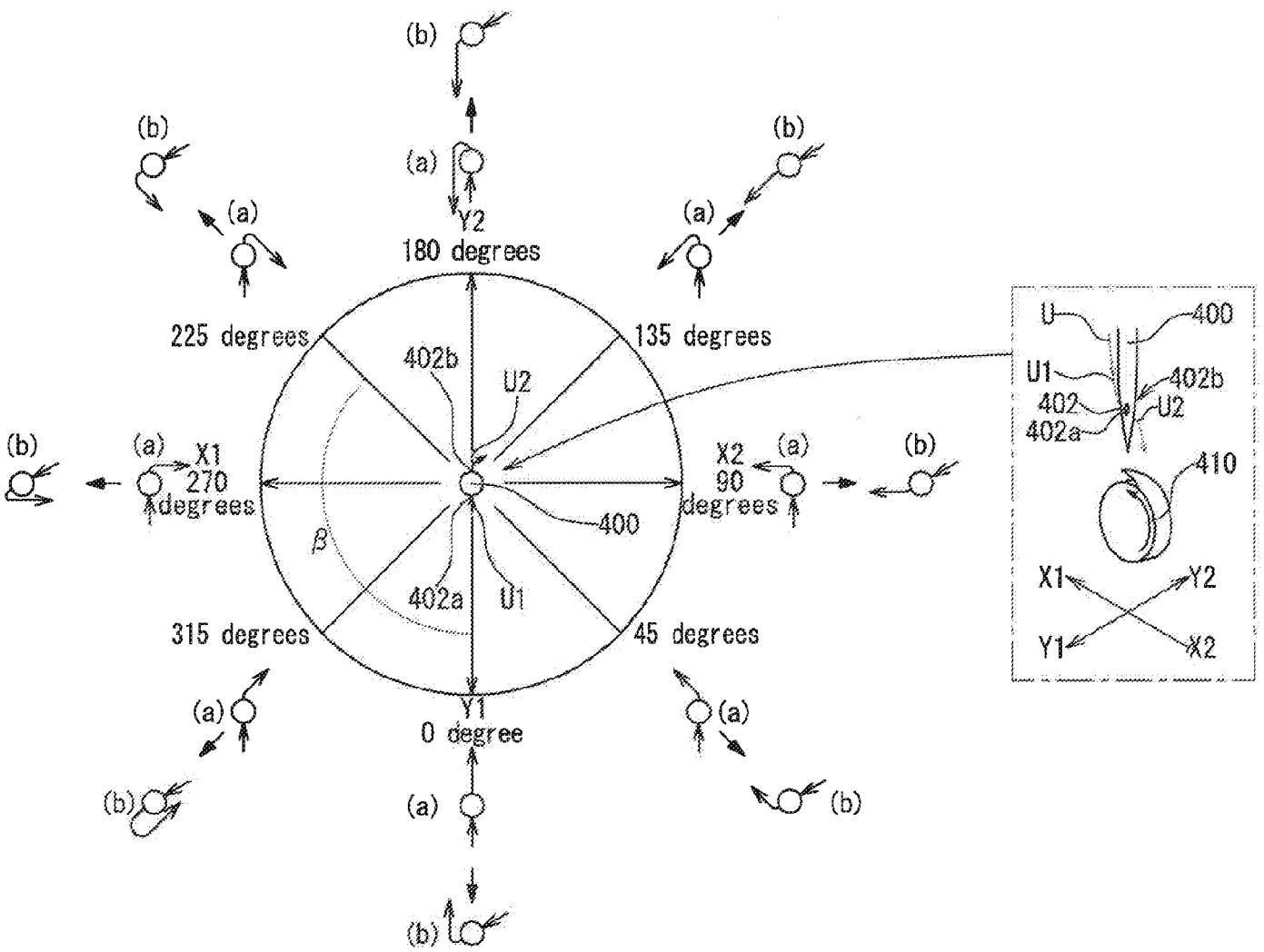
FIG. 25 is an explanatory view showing a state of the bobbin thread acquired in a direction in which the sewing needle performs movement relatively to a sewing frame, wherein (a) shows a state of the bobbin thread achieved before rotation of the sewing needle and wherein (b) shows a state of the bobbin thread achieved when the sewing needle is rotated.

The principle of prevention of a hitch stitch is specifically described by reference to FIG. 25. In FIG. 25, a pinhole 402 of a sewing needle 400 (the sewing needle 400 has the same configuration as that of the sewing needle 60 and the sewing needle 160) has a pair of openings 402*a* and 402*b*. Provided that a needle thread U comes into the opening 402*a* and comes out of the opening 402*b*, a part of the needle thread U preceding the pinhole 402 is taken as an upper needle thread U1, and a part of the needle thread U following the pinhole 402 is taken as a lower needle thread U2. The opening 402*a* is assumed to be positioned on a front side (Side Y1) of the sewing needle 400, and the opening 402*b* is assumed to be positioned on a rear side (Side Y2) of the sewing needle 400. A rotation axis of a shuttle 410 is assumed to lie in a front-back direction (a direction Y1-Y2). In each of the sewing needles 400 illustrated for respective angles, a short arrow denotes the upper needle thread U1, and a long arrow denotes the lower needle thread U2.

FIG. 25 illustrates a relative position of the sewing needle 400 with respect to a preceding needle location achieved after movement of a (unillustrated) sewing frame. For instance, a 225-degree point indicates a case where the sewing needle 400 makes movement at 225 degrees with respect to one preceding needle location. In reality, the sewing frame moves in a direction of 45 degrees. Reference symbol (a) at each angle depicts a direction of the upper needle thread U1 and a direction of the lower needle thread U2 achieved after relative movement of the sewing needle 400.

It is said that, in a case where the sewing needle 400 simply makes vertical movement as does in the relative art on the above premise, hitch stitches are prone to occur when the sewing needle 400 makes relative movement at any angle between 225 degrees and 360 degrees (=0 degree) (in a range of angle β). Specifically, the opening 402*b* (the opening out of which the needle thread comes) faces the rear side at the above angle, so that the hitch stitches are prone to occur.

In the present example, since the sewing needle is rotated counterclockwise 120 degrees when viewed from above in the course of the needle bar 5 shifting from the bottom dead center to the top dead center, the opening 402*b* faces a direction close to the front at the top dead center. In addition, since the opening 402*b* faces the direction close to the front and since the sewing needle is situated at an elevated position at the top dead center, the needle thread and the sewing needle are brought into slack engagement with each other, whereupon the lower needle thread U2 becomes apt to pass directly by the front side of the sewing needle from the opening 402*b*. Hence, even when in this state the sewing needle is inserted, while being rotated clockwise, into fabric to be sewn after shifting to the bottom dead center, occurrence of hitch stitches can be prevented. Specifically, the sewing needle rotates counterclockwise when viewed from above in the course of moving from the bottom dead center to the top dead center and returns to the original position by performing a shift from the top dead center to the bottom dead center. However, the lower needle thread U2 is prone to stay directly passed by the front side of the sewing needle from the opening 402*b* at the top dead center. Since the sewing needle is rotated clockwise in this state, occurrence of hitch stitches is prevented. Incidentally, reference symbols (b) in FIG. 25 show the sewing needle rotated counterclockwise, when viewed from above, 120 degrees from the position indicated by (a) at each angle. Both reference symbols (a) and (b) show a state of the sewing needle 400 when viewed from above.

A range (from 0 degree to 225 degrees) outside the angle β is an area where hitch stitches originally occur at very low frequency. Accordingly, even when the sewing needle is rotated as mentioned above, the frequency of occurrence of hitch stitches remains unchanged.

Conceivable means to rotate the opening 402*b*, which is directed rear, closely toward the front is to set an angle of rotation greater than 90 degrees to 180 degrees. However, it is preferable to set the angle of rotation in a range from 110 degrees to 135 degrees. Even when the angle of rotation is 90 degrees or less, occurrence of hitch stitches is prevented in some cases (for instance, when the angle is 225 degrees in FIG. 25, the lower bobbin thread U2 is pulled in a direction of 45 degrees. Hence, when the sewing needle comes to the top dead center, a frequency with which the lower bobbin thread U2 passes by the front side of the sewing needle is high). In order to prevent occurrence of hitch stitches sufficiently, it is preferable to set the angle of rotation greater than 90 degrees to 180 degrees; specifically, between 110 degrees and 135 degrees. It can be said that the angle of rotation of the helical portions 36*a*-2 and 36*b*2 from their upper to lower ends in the first example and the angle of rotation of the helical portions 136*a*-2 and 136*b*-2 from their upper to lower ends in a second example (which will be described later) are set preferably greater than 90 degrees to 180 degrees and, more preferably, between or equal to 110 degrees and 135 degrees.

Moreover, even when the needle bar connecting stud 220 and the needle bar up/down component 206 are brought out of engagement with each other as a result of horizontal sliding action of the needle bar case 210, the needle bar 5 is held at the top dead center by virtue of the needle bar holding spring 226. Incidentally, the needle bar case 210 performs sliding action while the needle bar 5 is held at the top dead center.

As above, operation of the needle bar up/down component 206 and operation of the presser foot up/down component 208 are similar to operation of their counterparts in the existing sewing machine illustrated in FIG. 13.

At the time of replacement of the needle bar 5, the needle bar connecting stud 220 is unfastened from the needle bar body 10, and the holder 70 is unfastened from the support 216 by unscrewing the screw 86 which secures the holder 70, whereby the needle bar 5 can be pulled upward. Moreover, when a new needle bar 5 is attached, the essential requirement is to insert the needle bar 5 into respective members (namely, the support 214, the presser foot connecting stud 222, the presser foot spring 228, the needle bar connecting stud 220, the support 212, the needle bar holding spring 226, and the support 216); to secure the needle bar connecting stud 220 to the needle bar body 10; and to secure the holder 70 to the support 216. When compared with the case described in connection with Patent Document 4, replacement of the needle bar 5 can be facilitated. In addition to the case of replacement of the needle bar, the same also applies to initial attachment of the needle bar. The only requirement is to do at the time of attachment and replacement of the needle bar 5 is to handle the needle bar 5 as is the case with an ordinary needle bar except detachment and attachment of the holder 70. Hence, the needle bar can be easily attached and replaced.

Figure 9:
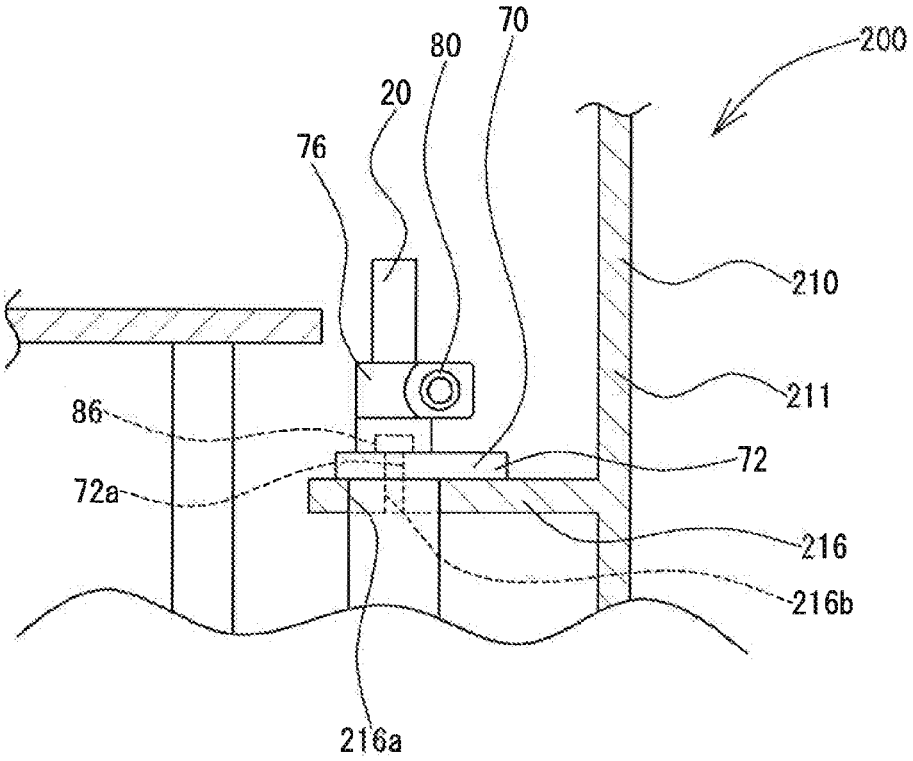
FIG. 9 is a cross-sectional view for describing the principal part illustrated in FIG. 8.
Figure 10:
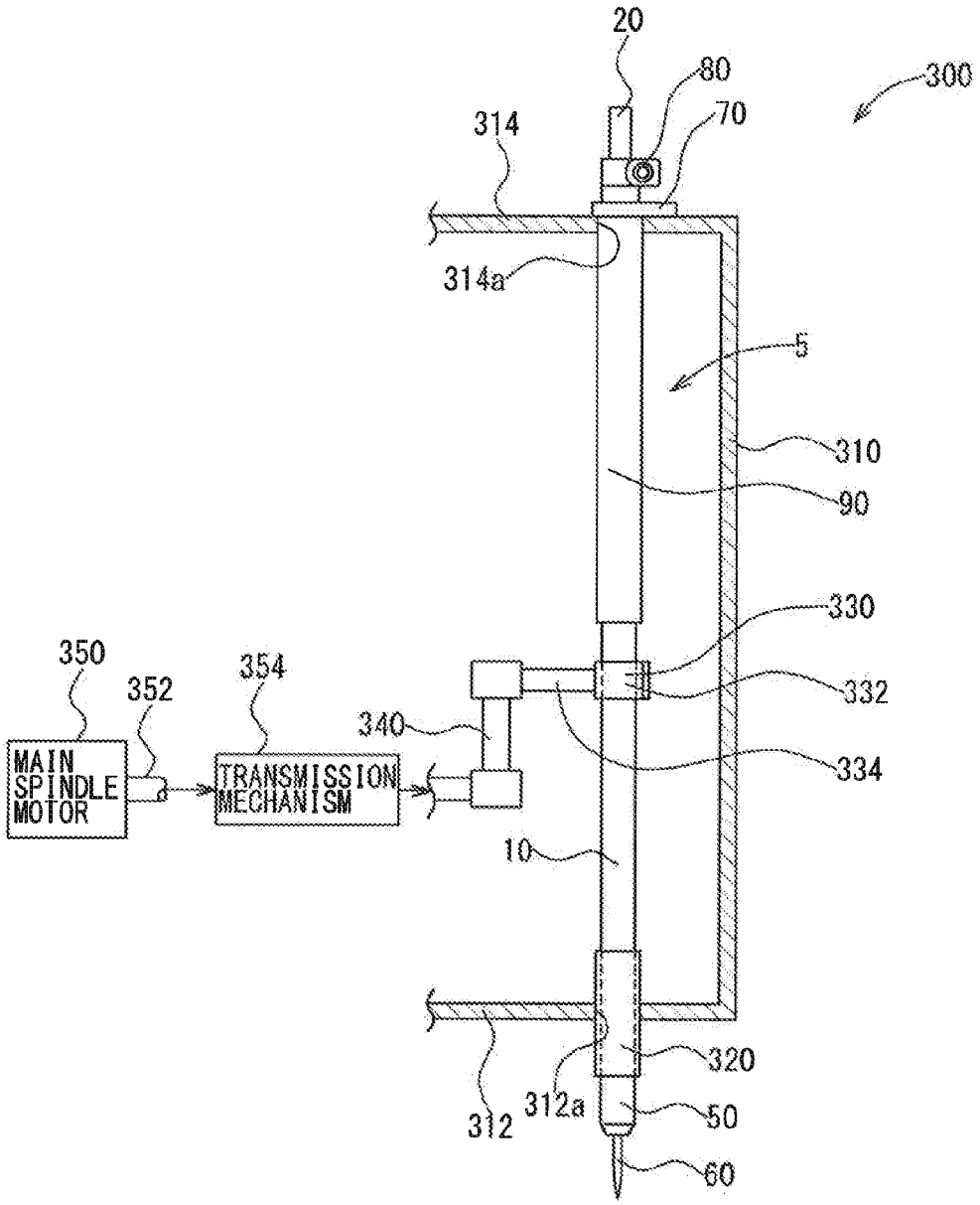
FIG. 10 is a cross-sectional view of the principal part acquired when the needle bar of the first example is applied to a sewing machine.

FIG. 10 illustrates a case where the needle bar 5 is applied to an ordinary sewing machine. In a sewing machine 300, an insert hole 312*a* is opened in a bottom surface 312 of a case 310 making up a housing of the sewing machine. A tubular portion 320 is secured to the insert hole 312*a*. An insert hole 314*a* for insertion of the cover 90 of the needle bar 5 and a threaded hole for screw-engagement of the screw 86 are opened in an upper surface 314. The needle bar 5 is inserted into the tubular portion 320 and the insert hole 314*a*, and the holder 70 is secured to the upper surface 314 with the screw 86. The threaded hole opened in the upper surface 314 is a threaded hole having the same configuration as that of the threaded hole 216*b* illustrated in FIG. 9. The upper surface 314 is a support member that fixedly supports the holder 70 with the screw (securing means) 86. A needle bar connecting stud 330 is made by securing a spindle 334 to a needle bar connecting stud body 332. The needle bar connecting stud body 332 is secured to the needle bar body 10, and the spindle 334 is secured to one end of a crank rod 340.

Accordingly, the needle bar connecting stud 330 is vertically moved by rotation of the crank rod 340. The needle bar 10 is also vertically moved along with the vertical movement of the needle bar connecting stud 330, whereby the rotation unit 65 initiates rotation. The crank rod 340 is rotated by a transmission mechanism 354 that transmits torque from a main spindle 352 rotated by a main spindle motor 350. For instance, a cam mechanism can be mentioned as the transmission mechanism 354. The crank rod 230 corresponds to the needle bar connecting stud up/down mechanism that vertically moves the needle bar connecting stud. The transmission mechanism 354, the main spindle motor 350, and the main spindle 352 also correspond to the needle bar connecting stud up/down mechanism.

Figure 14:
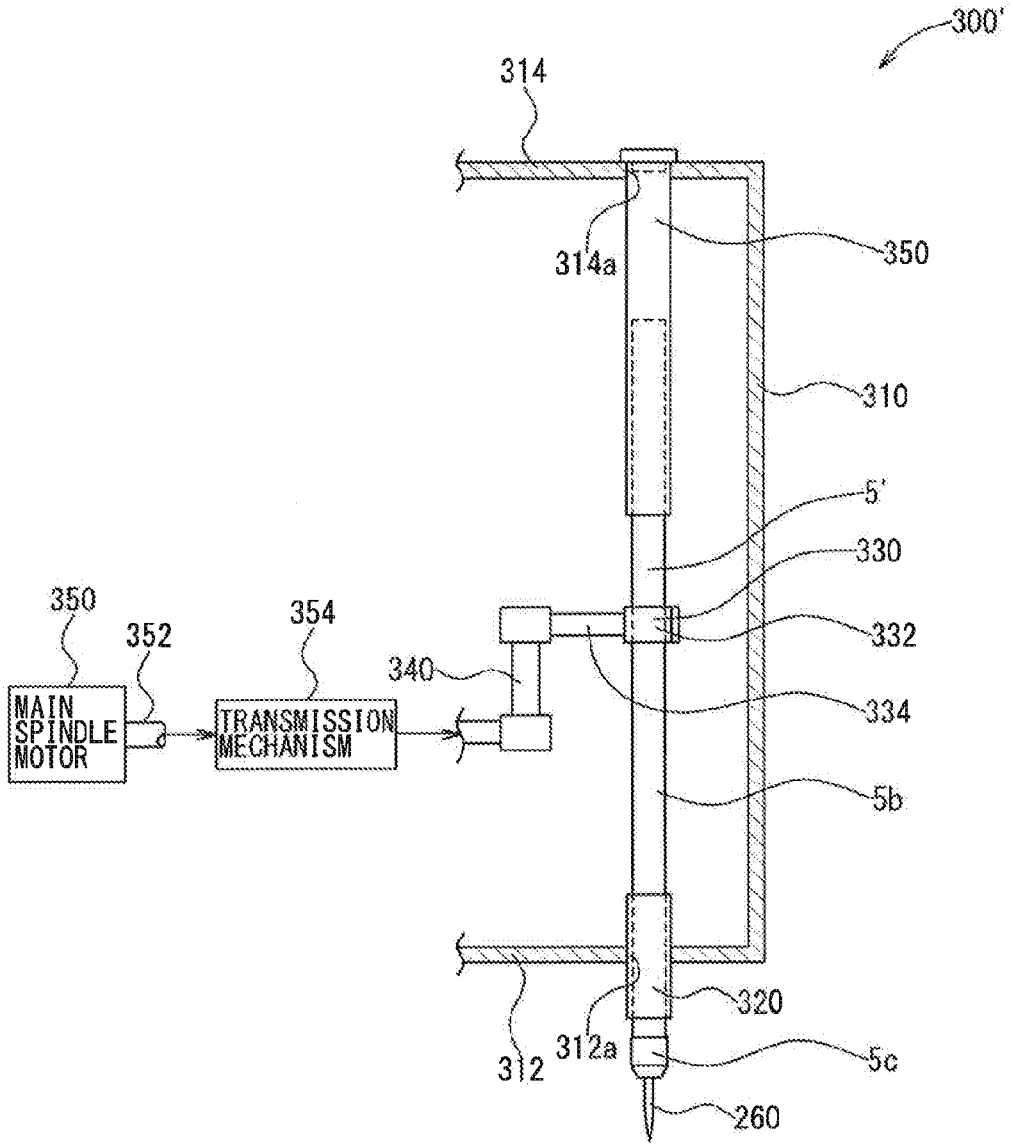
FIG. 14 is a cross-sectional view of the principal part showing the configuration of the existing embroidery sewing machine.
Figure 15:
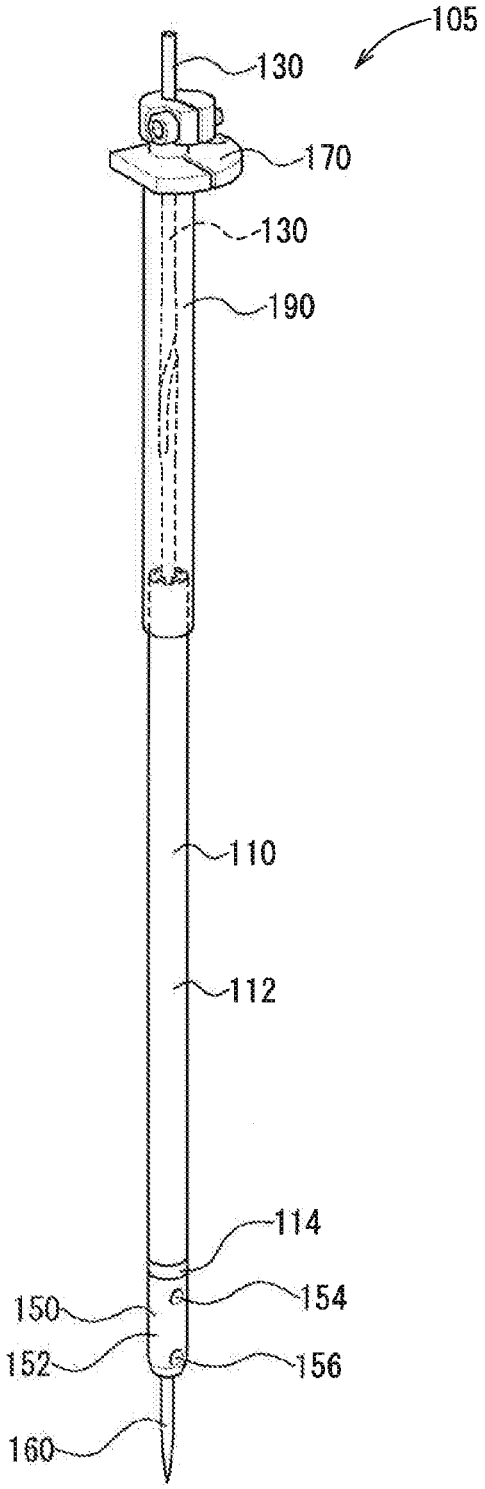
FIG. 15 is a perspective view of a needle bar (a second example)

When the configuration of the sewing machine 300 (the needle bar is excluded from the configuration) illustrated in FIG. 10 is compared with an example of an existing sewing machine illustrated in FIG. 14. In the example illustrated in FIG. 10, the case of the needle bar 5 is secured to the upper surface 314. Except that there is provided a tubular portion 350 for guiding the needle bar 5' to the upper surface 314, a sewing machine 300' illustrated in FIG. 14 has the same configuration. Specifically, in the example illustrated in FIG. 14, the tubular portion 320 is attached to the insert hole 312*a* of the bottom surface 312. The tubular portion 350 is attached downwardly to the insert hole 314*a* of the upper surface 314. Thus, the needle bar 5' is inserted into both the tubular portion 320 and the tubular portion 350. The needle bar connecting stud 330 is secured to the needle bar 5', and the crank rod 340 is attached to the needle bar connecting stud 330. Moreover, the sewing needle 260 is attached to a lower end of the tubular needle bar body 5*b* of the needle bar 5' illustrated in FIG. 14 by way of the needle bar connecting stud 5*c*.

Operation of the sewing machine 300 is described. When the needle bar connecting stud 330 descends as a result of the crank rod 340 rotating from the top dead center of the needle bar 5 illustrated in FIG. 11(*b*), the needle bar body 10 secured to the needle bar connecting stud 330 also descends. The cam shaft 30 then rotates clockwise when viewed from above in the same way as mentioned above, and the joint 50 and the sewing needle 60 also rotate clockwise when viewed from above.

When the needle bar connecting stud 330 ascends as a result of the crank rod 340 rotating from the bottom dead center of the needle bar 5 illustrated in FIG. 11(*a*), the needle bar body 10 secured to the needle bar connecting stud 330 also ascends. The cam shaft 30 then rotates counterclockwise when viewed from above in the same way as mentioned above, and the joint 50 and the sewing needle 60 also make counterclockwise rotation when viewed from above.

Since the rotation unit 65 also performs rotation along with vertical movement of the needle bar 5 (in a narrow sense, a configuration excluding the sleeve 20 and the cover 90), occurrence of hitch stitches can be prevented. In particular, when the needle bar 5 shifts from the bottom dead center to the top dead center, the sewing needle 60 makes 120-degree counterclockwise rotation when viewed from above. When the needle bar 5 shifts from the top dead center to the bottom dead center, the sewing needle 60 makes 120-degree clockwise rotation when viewed from above. Therefore, occurrence of hitch stitches can be prevented. Even in the case of an ordinary sewing machine, the sewing needle can be moved through 360 degrees relatively to a preceding needle location. Accordingly, the principle of prevention of hitch stitches is the same as that described in connection with the embroidery sewing machine, and the explanations provided in connection with FIG. 25 are applied to the ordinary sewing machine.

At the time of replacement of the needle bar 5, the needle bar connecting stud 330 is unfastened from the needle bar body 10, and the holder 70 is unfastened from the upper surface 314 by unscrewing the screw 86 which secures the holder 70, whereby the needle bar 5 can be pulled upward. Moreover, at the time of attachment of a new needle bar 5, the essential requirement is to insert the needle bar 5 into respective members (specifically, the upper surface 314, the needle bar connecting stud 330, and the tubular portion 320); to secure the needle bar connecting stud 330 to the needle bar body 10; and to fix the holder 70 to the upper surface 314. Accordingly, replacement of the needle bar 5 can be facilitated. In addition to the case of replacement of the needle bar, the same also applies to initial attachment of the needle bar. Specifically, the only requirement is to do at the time of attachment and replacement of the needle bar 5 is to handle the needle bar 5 as is the case with an ordinary needle bar except detachment and attachment of the holder 70. Hence, the needle bar can be easily attached and replaced.

In relation to the needle bar 5 of the present example, the sewing needle 60 can be rotated by vertical movement of the needle bar body 10. An additional mechanism for rotating the needle bar, like a motor and gears, is unnecessary.

Further, as mentioned above, all you need to do at the time of replacement of the needle bar 5 is to handle the needle bar 5 in the same way as is an ordinary needle bar except attachment and detachment of the holder 70. Hence, the needle bar can be easily attached and replaced.

As long as a plurality of types of needle bars that differ from each other in terms of the configuration of the grooves 36*a* and 36*b* of the cam shaft 30 are prepared, a needle bar can be replaced with an appropriate one according to a type of a fabric to be sewn, thread types (a needle thread and a bobbin thread), and an embroidery pattern. Conceivable configurations of the grooves 36*a* and 36*b* include the helical portions 36*a*-2 and 36*b*-2 having different lengths and the helical portions 36*a*-2 and 36*b*-2 having different rotation angles from their upper to lower ends.

In the needle bar 5, the balls 22 fitted in the respective openings 20*a* and 20*b* of the sleeve 20 are in engagement with the grooves 36*a* and 36*b*. The balls 22 rotate within the openings 20*a* and 20*b* and the grooves 36*a* and 36*b* at the time of rotation of the cam shaft 30. Accordingly, friction between the balls 22 and the sleeve 20 and friction between the balls 22 and the cam shaft 30 can be diminished, so that the rotation unit 65 can perform smooth rotation. Moreover, the pair of openings 20*a* and 20*b* are formed in the sleeve 20, and the pair of grooves 36*a* and 36*b* are formed in the cam shaft 30. The balls 22 are fitted in the respective openings and grooves. Hence, even in this regard, the rotation unit 65 can be smoothly rotated.

The needle bar 5 of the present example can be readily applied to existing sewing machines. Specifically, as can be seen from a comparison between FIG. 8 and FIG. 13, the essential requirement for the case of an embroidery sewing machine is to provide the needle bar case 210 with the support 216 for fixing the holder 70. Consequently, the needle bar 5 can be readily applied to existing sewing machines. Further, as can be seen from a comparison between FIG. 10 and FIG. 14, even in the case of ordinary sewing machines, the essential requirement is to remove the tubular portion 350 from the configuration of the existing example illustrated in FIG. 14 and fix the holder 70 of the needle bar 5 to the upper surface 314. Therefore, the needle bar 5 can be readily applied to existing sewing machines. Even in the case of a comparison with the needle bar rotation mechanism described in connection with Patent Document 4, the needle bar rotation mechanism of Patent Document 4 needs a needle bar support and a brace; hence, difficulty is encountered in applying the needle bar rotation mechanism to the existing sewing machines. However, in the present example, the needle bar can be easily applied to existing sewing machines except the configuration in which the holder 70 is secured. The needle bar 5 itself entirely assumes an approximately-columnar shape. Except that the needle bar is equipped with the holder 70 and the cover 90, the needle bar 5 assumes the same appearance as that of an ordinary needle bar. Even in this respect, the needle bar 5 can be said to be easily applied to existing sewing machines.

Second Example

A needle bar of a second example is now described. A needle bar 105 of the second example is a needle bar for use with a sewing machine and approximately has the same configuration as that of the needle bar 5 of the first example However, the needle bar 105 is different in terms of a mechanism for rotating the sewing needle. In the first example, the sleeve 20 in which the balls are to be placed is secured, and the cam shaft 30 is rotated. In the meantime, the second example is configured such that a sleeve 122 in which balls are to be placed is rotated, whereas the cam shaft 130 is secured.

A needle bar 105 of the present example is a needle bar. The needle bar 105 is configured as illustrated in FIG. 15 through FIG. 21 and entirely assumes an approximately-columnar shape. The needle bar 105 has a needle bar body 110; a rotation section 120 which is placed in the needle bar body 110 and a part of which protrudes from the needle bar body 110; the balls 22, one in an opening 120*a* and the other in an opening 120*b* of a sleeve 122 of the rotation section 120; a cam shaft 130 placed in the sleeve 122; a joint 150 that is secured to a guide pin 124 of the rotation section 120 and which is placed at a lower position on and rotatable with respect to the needle bar body 110 in order to secure a sewing needle 160; a holder 170 that fixedly holds the cam shaft 130 and that secures the needle bar 105 to another member; and a cover 190 fixedly provided on the holder 170 for covering the sleeve 122 and the cam shaft 130. A sewing needle (which may also be referred simply as a "needle") 160 is fixedly provided on the joint 150.

The needle bar body 110 is structurally similar to the needle bar body 10 of the first example and has a vertically-movable sleeve (a needle body sleeve) 112 and a guide bush 114 provided at a lower end of the vertically-movable sleeve 112. The vertically-movable sleeve 112 is structurally similar to the vertically-movable sleeve 12, and the guide bush 114 is structurally similar to the guide bush 14. Accordingly, their detailed explanations are omitted. The guide bush 114 has a cylindrical-shaped main body (a guide bush body) 16 and a cylindrical-shaped flange 18 provided so as to protrude from an outer circumferential surface of a lower end of the main body 16. In the needle bar body 110, an area of the guide bush 114 from its lower to upper ends makes up a small-diameter portion 10-1, and an area from the upper end of the guide bush 114 to an upper end of the vertically-movable sleeve 12 makes up a large-diameter portion 10-2.

The rotation section 120 has a sleeve 122 and a guide pin 124 fixedly provided at a lower end of the sleeve 122.

The sleeve 122 assumes a cylindrical shape, and the openings 120*a* and 120*b* used for placing the balls 22 are opened in an upper end portion of the sleeve 122. The sleeve 122 is inserted in the vertically-movable sleeve 121 of the needle bar body 10. The sleeve 122 rotates with respect to the needle bar body 110. However, unlike the first example, the needle bar body 110 does not perform sliding with respect to the sleeve 122.

Specifically, an outer diameter of the sleeve 122 is set to a length which is equal to or less an inner diameter of the vertically-movable sleeve 112 (preferably a length which is smaller than the inner diameter of the vertically-movable sleeve 112) such that the sleeve 122 can rotate within the vertically-movable sleeve 112. Incidentally, a value of half of a difference between the inner diameter of the vertically-movable sleeve 112 and an outer diameter of the sleeve 122 is set so as to become smaller than a diameter of the ball 22 such that the balls 22 do not fall into clearance between the sleeve 122 and the vertically-movable sleeve 112. Further, an outer diameter L122 of the sleeve 122 is made larger than a diameter of the insert hole 14K of the small-diameter portion 10-1. The sleeve 122 is made from metal.

The openings 120*a* and 120*b* are formed in the same shape and size and make up circular openings. The openings 120*a* and 120*b* are placed at positions where they are opposite to each other with an axis line of the sleeve 122 laid therebetween. An imaginary straight line connecting the center of the opening 120*a* to the center of the opening 120*b* intersects the axis line of the sleeve 122 at right angle. The openings 120*a* and 120*b* are formed so as to penetrate the sleeve 20 from its outer circumferential surface to inner circumferential surface. Sizes of the openings 120*a* and 120*b* are determined such that the balls 22 can rotate within the respective openings 120*a* and 120*b*. Diameters of the openings 120*a* and 120*b* are determined so as to become equal to or larger than the diameter of the ball 22.

In order for the balls 22 to protrude from the inner circumferential surface of the sleeve 122 and come into engagement with the grooves 136*a* and 136*b*, a thickness L2 of a tube making up the sleeve 122 (in other words, a difference between the outer diameter and inner diameter of the sleeve 122) is set so as to become smaller than the diameter of the ball 22.

The balls 22 are provided respectively in the openings 120*a* and 120*b* of the sleeve 122, wherein one of the pair of balls 22 comes into engagement with the groove 136*a* and the other comes into engagement with the groove 136*b*. The ball 22 assumes a spherical shape and is specifically made of a chrome ball. Like the balls 22 of the first example, the balls 22 can also be formed from another material. The opening 120*a* is one opening, and the opening 120*b* is the other opening. The groove 136*a* is one groove, and the groove 136*b* is the other groove.

The guide pin 124 has a disc-shaped portion 126 and a lower shaft 128 extending downward from a lower surface of the disc-shaped portion 126. The guide pin 124 is formed in one from metal (specifically stainless steel (SUS)).

The disc-shaped portion 126 assumes the shape of a disc (or may also assume a columnar shape). An outer diameter (or a diameter) L126 of the disc-shaped section 126 is set to a length that is equal to or smaller than the inner diameter of the vertically-movable sleeve 112 (preferably a length that is equal to or smaller than the inner diameter of the vertically-movable sleeve 112) such that the disc-shaped portion 126 can rotate within the vertically-movable sleeve 112. The outer diameter L126 is also set to a length larger than the inner diameter of the guide bush 114. The disc-shaped portion 126 is positioned within the vertically-movable sleeve 112 and placed on an upper surface of the guide bush 114. Incidentally, an upper surface of the disc-shaped portion 126 is secured to a lower surface of the sleeve 122 with an adhesive.

The lower shaft 128 assumes a columnar shape and is inserted into the guide bush 114 and formed to a length which allows insertion of the lower shaft 128 into the joint 150. Moreover, the diameter of the lower shaft 128 is set to a length that is equal to or smaller than an insert hole of the guide bush 114 (preferably a length smaller than the insert hole of the guide bush 114) such that the lower shaft 128 can perform rotation with respect to the guide bush 114. Further, the diameter of the lower shaft 128 is set to a size that allows insertion of the lower shaft 128 into an insert hole of the joint 150.

The axis line of the sleeve 122, an axis line of the disc-shaped portion 126, and an axis line of the lower shaft 128 are determined so as to come into alignment with each other.

The cam shaft 130 assumes the shape of an axis, and a pair of grooves 136*a* and 136*b* are formed in its circumferential surface. Specifically, the groove 136*a* and the groove 136*b* are formed at positions where they are opposite to each other with the axis line of the cam shaft 130 laid therebetween. The grooves 136*a* and 136*b* are formed so as to become symmetrical about a point with the axis line of the cam shaft 130 laid therebetween. The cam shaft 130 is formed in one from stainless steel (SUS). The cam shaft 130 has a configuration in which the pair of grooves 136*a*, 136*b* are formed in a columnar shaft-shaped member.

Each of the grooves 136*a*, 136*b* continually has, in sequence from above, a straight portion, a helical portion, and another straight portion. For instance, the groove 136*a* has a straight portion 136*a*-1, a helical portion 136*a*-2, and a straight portion 136*a*-3. The groove 136*b* has a straight portion 136*b*-1, a helical portion 136*b*-2, and a straight portion 136*b*-3. The straight portions 136*a*-1, 136*a*-3, 136*b*-1, and 136*b*-3 are straight grooves parallel to the axis line of the cam shaft 130. Each of the helical portions 136*a*-2 and 136*b*-2 has a rotation angle of about 120 degrees (or exactly 120 degrees) from its upper end to lower end. For instance, a center position 136P of the groove on the upper end of the helical portion 136*a*-2 corresponds to a position on a lower end of the helical portion 136*a*-2 that is rotated about 120 degrees with respect to the center position on the upper end. The helical portion 136*a*-2 and the helical portion 136*b*-2 are helical grooves.

The helical portions 136*a*-2 and 136*b*-2 are formed in a direction in which the cam shaft 130 rotates counterclockwise when viewed from above in the course of the needle bar 5 shifting from the bottom dead center to the top dead center. Specifically, the helical portions 136*a*-2 and 136*b*-2 are formed clockwise in a circumferential surface of the cam shaft 130. Namely, the helical portions 136*a*-2 and 136*b*-2 are formed in a clockwise helical pattern (or a right-handed helical pattern). As a result, the sewing needle 160 rotates counterclockwise when viewed from above in a course of the needle bar 105 shifting from the bottom dead center to the top dead center. In the course of the needle bar 105 shifting from the top dead center to the bottom dead center, the sewing needle 160 rotates clockwise when viewed from above.

The groove 136*a* is formed to a depth such that the ball 22 is in engagement with the groove 136*a* while placed within the opening 120*a*. Likewise, the groove 136*b* is formed to a depth such that the ball 22 is in engagement with the groove 136*b* while placed within the opening 120*b*.

Grooves are not formed in areas of the cam shaft 130 above the upper ends of the grooves 136*a* and 136*b*. Further, grooves are not formed in areas of the cam shaft 130 below lower ends of the grooves 136*a* and 136*b*. Specifically, the cam shaft 130 has a groove-free columnar upper portion 131, an intermediate portion 132 with the grooves 136*a* and 136*b*, and a columnar lower portion 133 in which the grooves 136*a* and 136*b* are not formed. The lower end of the upper portion 131 is continually followed by the intermediate portion 132, and a lower end of the intermediate portion 132 is continually followed by the lower portion 133. Naturally, an outer diameter L130 (or may be referred to also as a "diameter") (in particular, an outer diameter of the intermediate portion 132) of the cam shaft 130 (in other words, a distance between mutually-opposed outer circumferential surfaces in an outer circumferential surface of the intermediate portion 132 where grooves are not formed) is set to a distance that enables the sleeve 122 to rotate with respect to the cam shaft 130. Specifically, the outer diameter of the cam shaft 130 is set to a length that is equal to or smaller than the inner diameter of the sleeve 122 (preferably smaller than the inner radium of the sleeve 122). Further, the outer diameter L130 of the cam shaft 130 (particularly, the outer diameter of the intermediate portion 132) and the inner diameter of the sleeve 122 are determined such that the balls 22 will not fall into clearance between the sleeve 122 and the cam shaft 130. Specifically, a value of half of a difference between the inner diameter of the sleeve 122 and the outer diameter L130 of the cam shaft 130 is set so as to become smaller than the diameter of the ball 22.

Since the holder 170 fixedly supports the upper portion 131 of the cam shaft 130, the upper portion 131 is formed so as to protrude upwardly from the needle bar body 110 even when the needle bar body 110 is situated at the top dead center. Incidentally, although the cam shaft 130 upwardly protrudes from an upper end of the holder 170, the cam shaft 130 may also be prevented from protruding upwardly from the holder 170 by placing the upper end of the cam shaft 130 and the upper end of the holder 170 into line.

The joint 150 is also structurally the same as the joint 50 of the first example. The joint 150 has a cylindrical joint body 152 whose lower end is chamfered, a screw (a first screw) 154 screw-engaged with a threaded hole 152*a* of the joint body 152, and a screw (a second screw) 156 screw-engaged with a threaded hole 152*b* of the joint body 152.

An insert hole 152K running through the joint body 152 from its upper to lower ends is formed, and the lower shaft 128 of the guide pin 124 and the sewing needle 160 can be inserted into the insert hole 152K. Specifically the lower shaft 128 is inserted into the joint body 152 from its upper side, and the sewing needle 160 is inserted into the joint body 152 from its lower side. A threaded hole 152*a* for screw-engagement with the screw 154 used for securing the lower shaft 128 and a threaded hole 152*b* for screw-engagement with the screw 156 used for securing the sewing needle 160 are formed in a side surface of the joint body 152 so as to penetrate through the joint body 152 from its outer circumferential surface to inner circumferential surface. The threaded hole 154 is formed at a position higher than the threaded hole 156. The insert hole 152K is a hole for insertion of the lower shaft 128 and the sewing needle 160. The threaded hole 152*a* is a threaded hole for securing a lower shaft, and the threaded hole 152*b* is a threaded hole for securing a sewing needle.

The screw 154 is screw-engaged with the threaded hole 152*a*, and the screw 156 is screw-engaged with the threaded hole 152*b*. The screw 154 and the screw 156 are structurally identical with each other. The joint 150 is a connection section for connecting the lower shaft 128 to the sewing needle 160.

When the lower shaft 128 remains secured to the joint 150, the guide bush 114 is sandwiched between the joint 150 and the disc-shaped section 126, and an upper surface of the joint body 152 stays in contact with a lower surface of the guide bush 114. Even when the joint 150 makes rotation, the joint 150 rotates while the upper surface of the joint body 152 is held in contact with the lower surface of the guide bush 114.

An outer diameter of the joint body 152 is approximately equal (or exactly identical) to an outer diameter of the guide bush 114. The vertically-movable sleeve 112, the guide bush 114, and the joint 150 are thereby formed so as to assume an approximately the same outer diameter (can also have exactly the same diameter). An outer circumferential surface of a structure made up of the needle bar body 110 and the joint 150 forms one columnar circumferential surface, except the chamfered lower end of the joint 150, and thus the needle bar body 110 and the joint 150 are flush with each other.

The sewing needle 160 is inserted into the insert hole 152K of the joint body 152 and secured with the screw 156, protruding downward with reference to a lower surface of the joint body 152. The sewing needle 160 is secured to the joint 150 of the needle bar 105, thereby constituting a needle bar unit. More specifically, the needle bar unit is made up of the needle bar 105 and the sewing needle 160.

As above, the lower shaft 128 of the guide pin 124 is secured to the joint 150, and the sewing needle 160 is secured to the joint 150. Hence, while the sewing needle 160 remains secured to the joint 150, the rotation section 120, the joint 150, and the sewing needle 160 are combined into one (in other words, a rotation unit 165 is comprised of the rotation section 120, the joint 150, and the sewing needle 160). The rotation unit 165 makes rotation with respect to the needle bar body 110 and the cam shaft 130.

Figure 16:
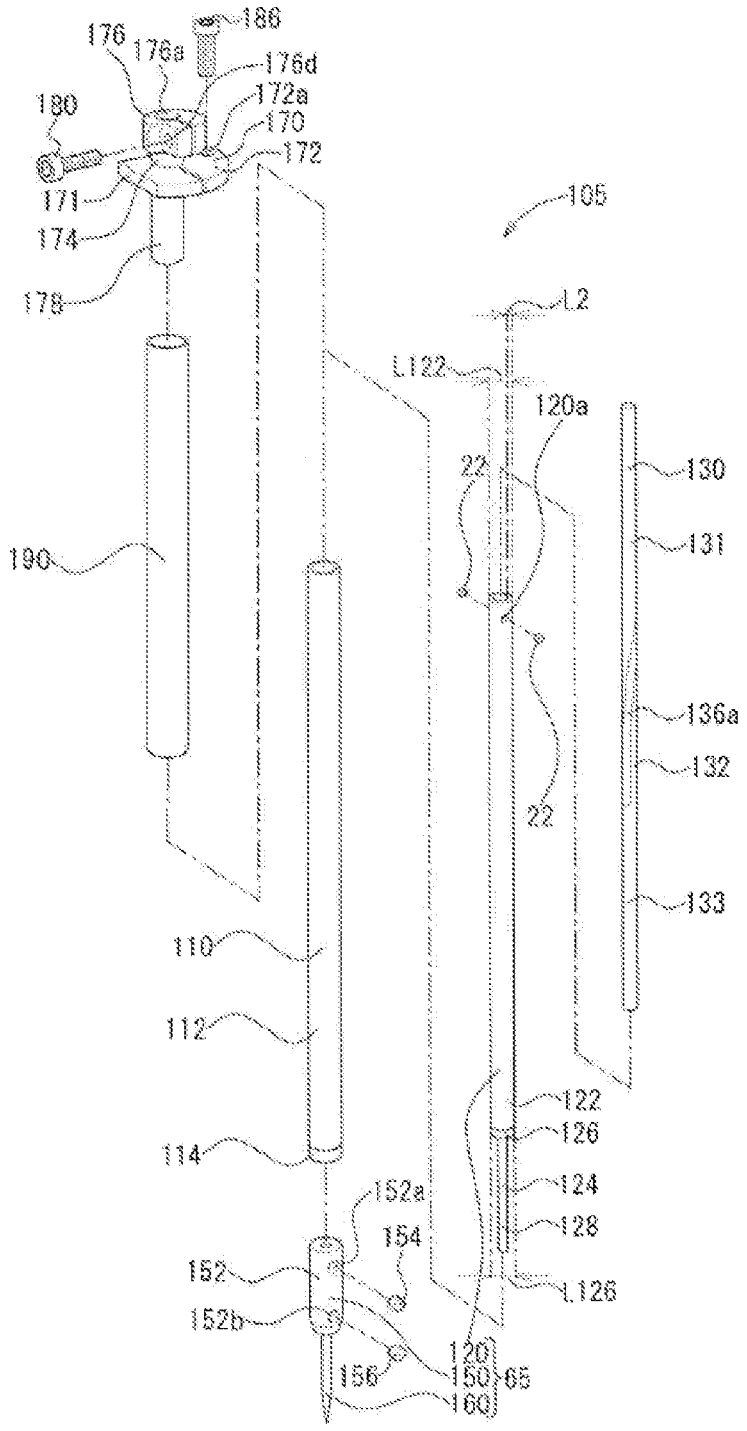
FIG. 16 is an exploded perspective view of the needle bar (the second example)
Figure 17:
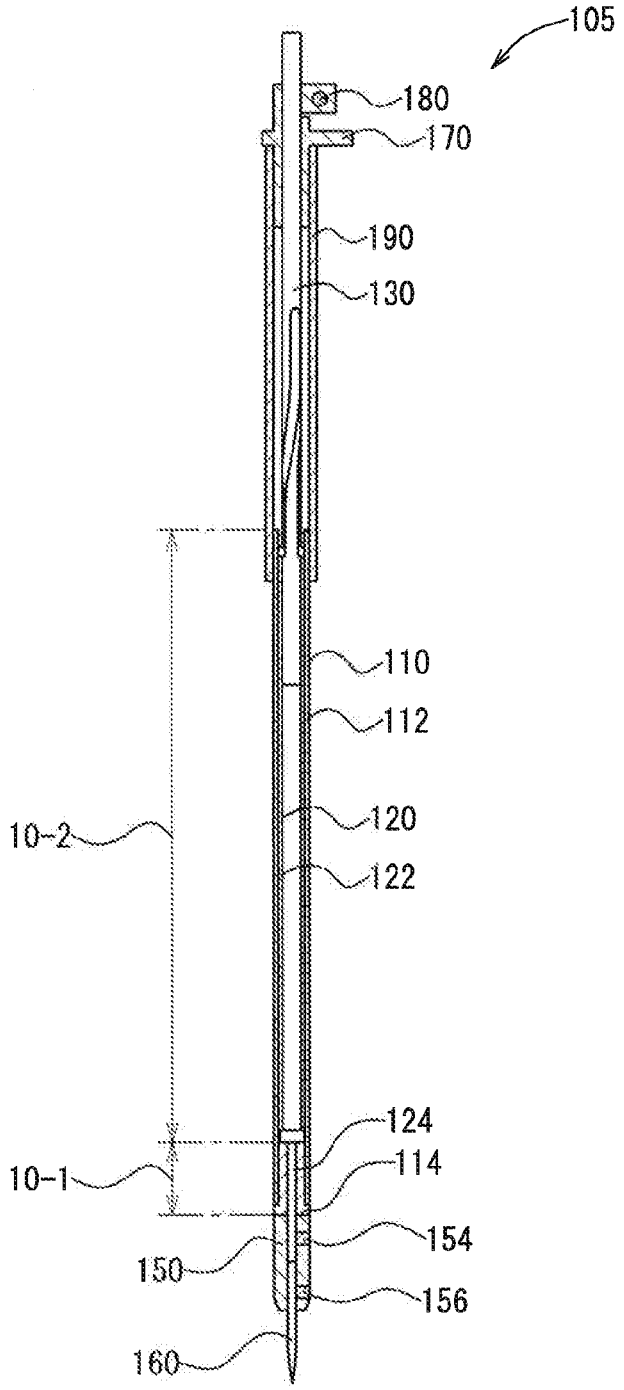
FIG. 17 is a longitudinal cross-sectional view of the needle bar (the second example)
Figure 18:
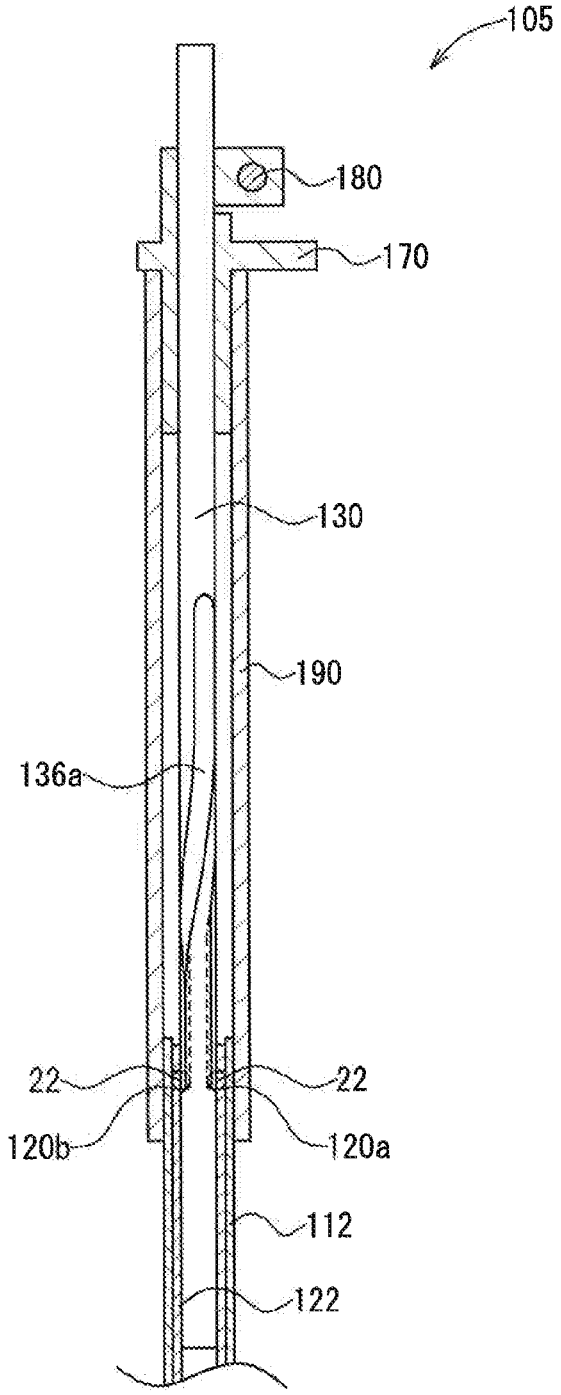
FIG. 18 is an enlarged view of a principal part illustrated in FIG. 16 (the second example)
Figure 19:
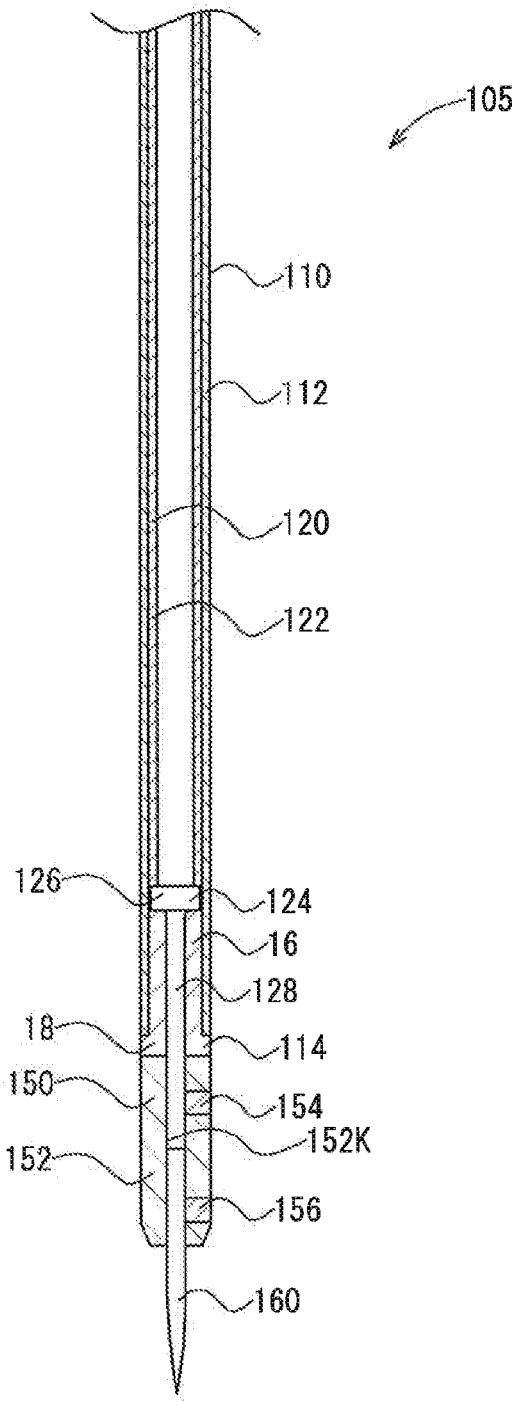
FIG. 19 is an enlarged view of the principal part illustrated in FIG. 16 (the second example)
Figure 20:
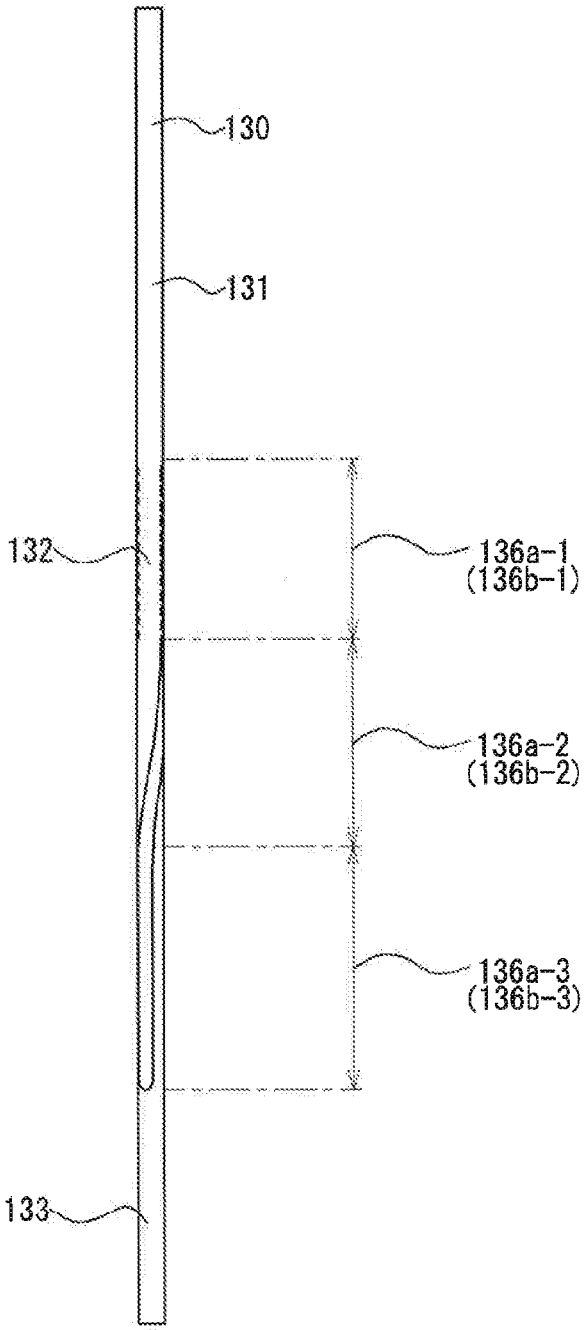
FIG. 20 is a front view of a cam shaft (the second example)
Figure 21:
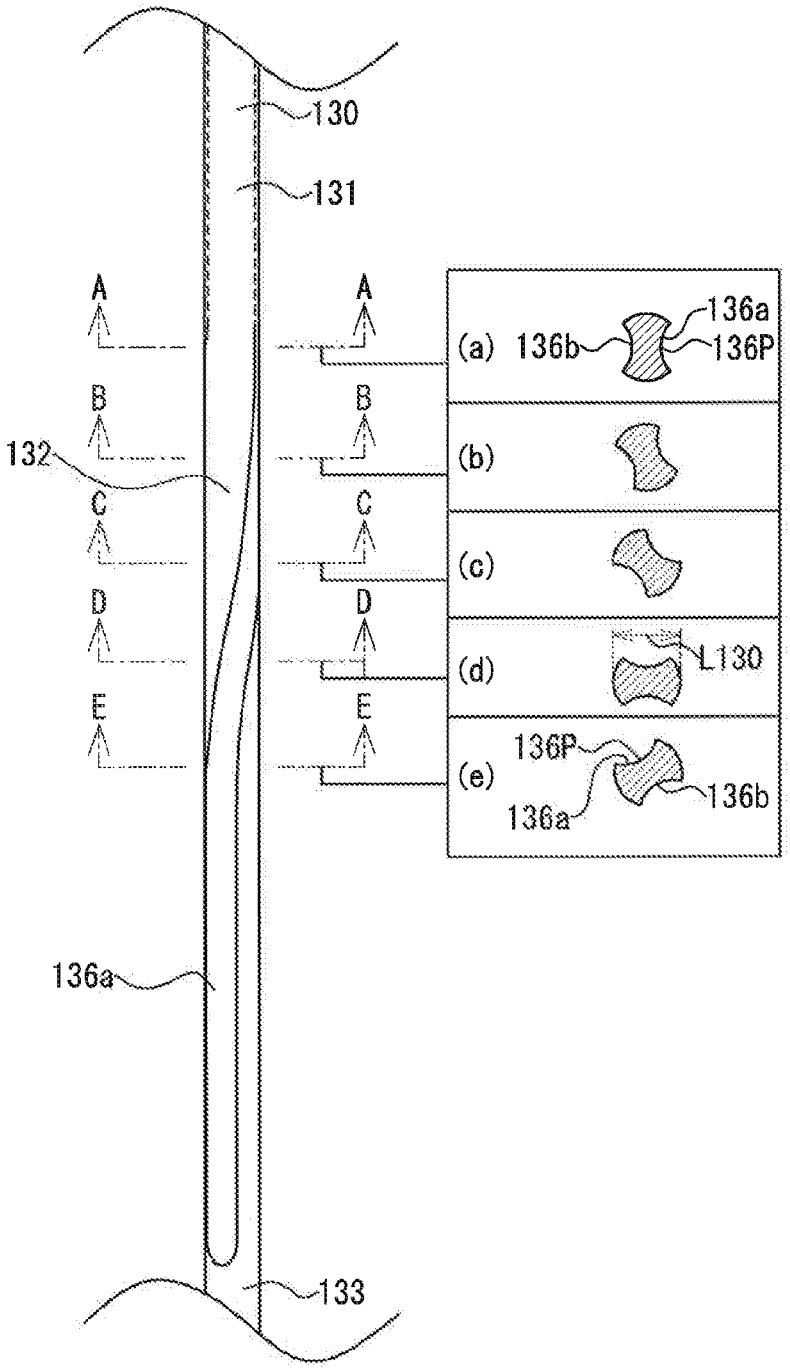
FIG. 21 is an enlarged view of a principal part of the cam shaft, wherein (a) is an end elevation view taken along A-A, wherein (b) is an end elevation view taken along B-B, wherein (c) is an end elevation view taken along C-C, wherein (d) is an end elevation view taken along D-D, and wherein (e) is an end elevation view taken along E-E (the second example)

The holder 170 is structurally similar to the holder 70. Specifically, the holder 170 is a member which is to be secured to another member (e.g., a member constituting the housing of the sewing machine) and which is for securing the needle bar 105. As illustrated in FIG. 16, the holder 170 has a holder body 171 and a bolt 180 screw-engaged with the holder body 171. The holder body 171 is made from a synthetic resin.

The holder body 171 is structurally similar to the holder body 71 of the holder 70. The holder body 171 has a plate 172, a tubular portion 174 formed so as to protrude up from an upper surface of the plate 172, a fixed portion 176 continually extending from an upper end of the tubular portion 174, and a tubular portion 178 formed so as to protrude downward from a lower surface of the plate 172.

The plate 172 is structurally similar to the plate 72. The tubular portion 174 is structurally similar to the tubular portion 74. The fixed portion 176 is structurally similar to the fixed portion 76. The tubular portion 178 is structurally similar to the tubular portion 78. Hence, their detailed explanations are omitted. The bolt 180 is structurally similar to the bolt 80, and hence its explanations are omitted.

As above, an insert hole for insertion of the upper portion 131 of the cam shaft 130 is formed in the holder 170. As to the holder 170, the bolt 180 is screw-engaged and fastened to the threaded hole 176*d* with the cam shaft 130 inserted in the insert hole, whereby the cam shaft 130 is secured to the holder 170. Further, the plate 172 is attached to another member by inserting a screw (securing means) 186 into an insert hole 172*a*, whereby the holder 170 is fastened to the another member.

The upper portion 131 of the cam shaft 130 is inserted into the holder 170. However, a diameter of the upper portion 131 of the cam shaft 130 is smaller than the outer diameter of the sleeve 20 of the first example. Accordingly, the diameter of the insert hole into which the upper portion 131 of the cam shaft 130 of the holder 170 is to be inserted is made smaller than the diameter of the insert hole of the holder 70 of the first example. Accordingly, the holder 170 can be formed so as to become smaller than the holder 70. In particular, when compared with the holder 70, at least the tubular portion 174 and the fixed portion 176 can be formed small because the diameter of the insert hole is small. In the case of a multi-needle embroidery sewing machine, the plate 172 is provided as a common structure for a plurality of needle bars (in other words, the plate 172 is configured so as to have a long width equal to the plurality of needle bars) and there is adopted a configuration in which the tubular portion 174 and the fixed portion 176 are provided for each of the needle bars. Therefore, the tubular portion 174 and the fixed portion 176 can be made smaller than their counterparts described in connection with the first example. Hence, an interval between adjoining needle bars can be made smaller. Even when the interval between adjacent needles is small, the needle bar is easily applicable to the multi-needle embroidery sewing machine.

The cover 190 assumes a tubular shape, and an inner circumferential surface of the cover 190 is secured to an outer circumferential surface of the tubular portion 178 of the holder 170 by means of press-fitting, etc. A length of the cover 190 along a direction of its axis line is set to a length which makes it possible to cover an upper end portion of the needle bar body 110. Specifically, the length is set to a length which covers an area up to an upper end portion of the vertically-movable sleeve 112 when the needle bar body 110 is situated at the bottom dead center. Specifically, in order to prevent intrusion of contaminants, like dust, into clearance between the sleeve 112 and the cam shaft 130, the cover 190 sheathes a portion of the cam shaft 130 exposed at the needle bar body 110. An inner diameter of the cover 190 is set to a length that is equal to or larger than the outer diameter of the vertically-movable sleeve 112 (preferably, a length which is larger than the outer diameter of the vertically-movable sleeve 112). The diameter of the cover 190 corresponds to a length that is approximately the same as the outer diameter of the tubular portion 178 of the holder 170.

In the needle bar 105 having the above configuration, the needle bar body 110 is vertically moved while the sewing needle 160 remains secured to the joint 150 and while the holder 170 remains secured to another member, whereby the rotation unit 165; in other words, the rotation section 120, the joint 150, and the sewing needle 160 perform rotation. Specifically, the balls 22 placed in the openings 120*a*, 120*b* of the sleeve 122 are in engagement with the respective grooves 136*a*, 136*b*, changes occur in the relative positions of the balls 22 in the grooves 136*a*, 136*b* by vertical movement of the needle bar body 110. Thus, the rotation section 120 is rotated, and the joint 150 and the sewing needle 160 are also rotated as a result of rotation of the rotation section 120. The needle bar body performs vertical movements but does not perform rotation. In the meantime, since the outer diameter of the disc-shaped portion 126 is larger than the inner diameter of the guide bush 114, the rotation section 120 will not downwardly fall from the needle bar body 110. Moreover, since the guide pin 124 is secured to the joint 150, the rotation section 120 will not upwardly come out of the needle bar body 110.

As mentioned above, the needle bar 105 itself entirely assumes an approximately-columnar appearance. The needle bar 105 assumes an appearance similar to an appearance of an ordinary needle bar except that it has the holder 170 and the cover 190.

In the needle bar 105, the needle bar body 110, the rotation section 120, the cam shaft 130, the joint 150, and the cover 190 are formed such that their axis lines (center lines) are in agreement with each other.

Figure 22:
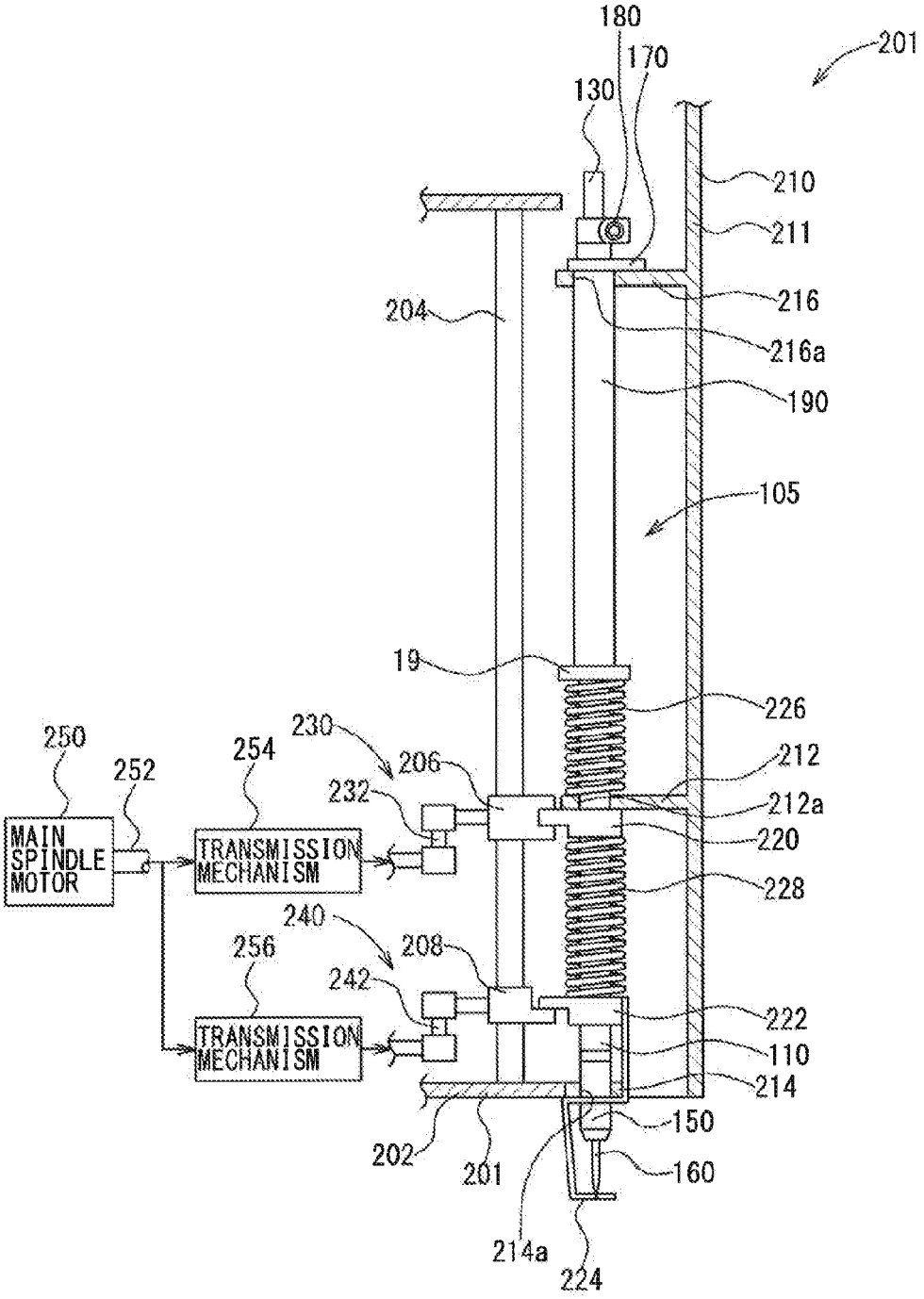
FIG. 22 is a cross-sectional view of the principal part acquired when the needle bar of the second example is applied to the embroidery sewing machine.

A specific state of use of the needle bar 105 having the above configuration is now described. First, an explanation is given to a case where the needle bar 105 is applied to the embroidery sewing machine. As illustrated in FIG. 22, the embroidery sewing machine 201 (hereinafter referred to simply as a "sewing machine 201") has a configuration similar to that of the sewing machine 200 illustrated in FIG. 8 except that it has the needle bar 105 in lieu of the needle bar 5.

The needle bar 105 is inserted into the supports 212, 214 of the needle bar case 210 and supported by the support 216 in the needle bar case 210. The support 216 has a hole 216*a* for insertion of the needle bar 105 (especially a cover 190) and a threaded hole for screw-engagement with the screw 186 (a threaded hole having a configuration similar to that of the threaded hole 216*b* illustrated in FIG. 9). Hence, the holder 170 is secured to the support 216 by inserting the cover 190 into the hole and bringing the screw 186 into screw-engagement with the threaded hole. In this regard, the cam shaft 130 is secured to the holder 170. More specifically, the support 216 corresponds to a support member that fixedly supports the holder 170 with the screw (securing means) 186. As in the case with the first example, the needle bar up/down component 206 corresponds to a needle bar connecting stud up/down mechanism. Moreover, the crank rod 232, the transmission mechanism 254, the main spindle motor 250, and the main spindle 252 also correspond to the needle bar connecting stud up/down mechanism.

Compared with the existing example illustrated in FIG. 13, the sewing machine 201 (except the needle bar) illustrated in FIG. 22 is structurally identical with the existing example illustrated in FIG. 13 except that it has the support 216 for securing the needle bar 105 at the upper end.

Operation of the sewing machine 201 is now described. When the needle bar connecting stud 220 descends as a result of the needle bar up/down component 206 being lowered from the top dead center of the needle bar 105 illustrated in FIG. 22 and FIG. 24(*b*), the needle bar body 110 secured to the needle bar connecting stud 220 descends. The cam shaft 130 is secured, and hence no change occurs in its position (the cam shaft 130 remains unchanged in both the vertical direction and the direction of rotation). Therefore, changes occur in the relative positions of the balls 22 in the grooves 136*a* and 136*b*. Since the grooves 136*a* and 136*b* are formed in the clockwise direction, the rotation section 120 performs clockwise direction when viewed from above. As a result of the rotation section 120 being rotated clockwise, the joint 150 and the sewing needle 160 are also rotated clockwise when viewed from above. Namely, the sewing needle 160 descends while performing clockwise rotation.

The needle bar connecting stud 220 pushes the presser spring 228 from above when descending, and the presser foot connecting stud 222 also moves downwardly. The presser foot up/down component 208 also descends along with downward movement of the presser foot connecting stud 222. The needle bar connecting stud 220 keeps descending even after the presser foot connecting stud 222 comes into contact with the support 214, whereupon the needle bar body 110 keeps descending.

Figure 24:
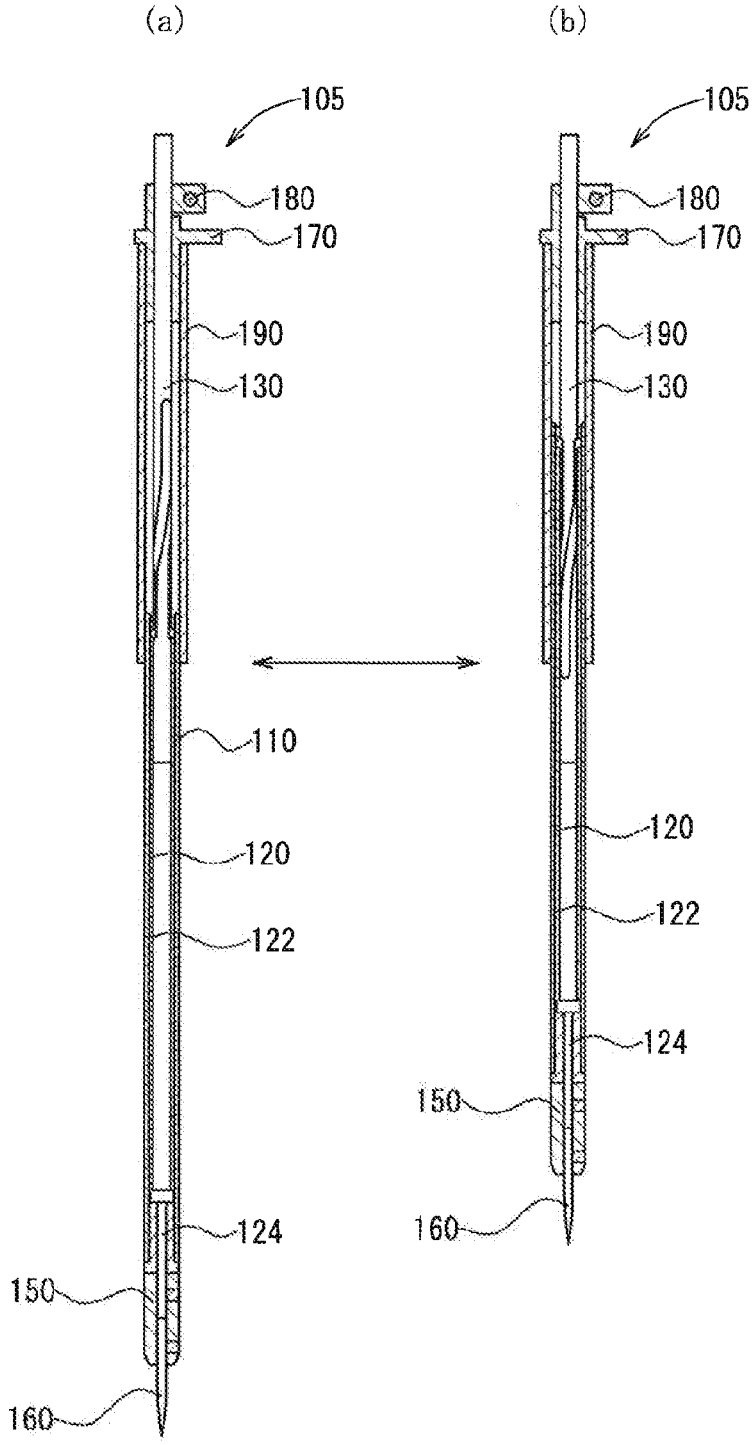
FIG. 24 is a longitudinal cross-sectional view for describing operation of the needle bar, wherein (a) is a longitudinal cross-sectional view acquired when the needle bar is situated at the bottom dead center and wherein (b) is a longitudinal cross-sectional view acquired when the needle bar is situated at the top dead center (the second example)

Next, when the needle bar connecting stud 222 ascends as a result of the needle bar up/down component 206 moving upward from the bottom dead center of the needle bar 105 illustrated in FIG. 24(*a*), the needle bar body 110 secured to the needle bar connecting stud 220 starts ascending. Changes then occur in the relative positions of the balls 22 in the respective grooves 136*a*, 136*b*. Since the grooves 136*a*, 136*b* are formed in a clockwise direction, the rotation section 120 rotates counterclockwise when viewed from above. As a result of the rotation section 120 rotating counterclockwise, the joint 150 and the sewing needle 160 also rotate counterclockwise when viewed from above. Specifically, the sewing needle 160 ascends while performing counterclockwise rotation.

When the needle bar up/down component 206 ascends, the presser foot up/down component 208 also ascends, whereby the presser foot connecting stud 222 and the presser foot 224 move upward.

Since the rotation unit 165 rotates along with vertical movement of the needle bar 105 (in a narrow sense, the configuration except the cam shaft 130 and the cover 190), occurrence of hitch stitches can be prevented. Especially, when the needle bar 105 shifts from the bottom dead center to the top dead center, the sewing needle 160 makes 120-degree counterclockwise rotation when viewed from above. Further, when the needle bar 105 shifts from the top dead center to the bottom dead center, the sewing needle 106 performs 120-degree clockwise rotation when viewed from above. Hence, occurrence of hitch stitches can be prevented. The principle of prevention of hitch stitches is the same as that described in connection with the first example, and hence its detailed explanations are omitted.

As in the case with the first example, the needle bar connecting stud 220 is unfastened from the needle bar body 110 on occasion of replacement of the needle bar 105. The holder 170 is unfastened from the support 216 by unscrewing the screw 186 used for securing the holder 170. The needle bar 105 can thereby be pulled upward. Further, when a new needle bar 105 is attached, the essential requirement is to insert the needle bar 105 into respective members (specifically the support 214, the presser foot connecting stud 222, the presser foot spring 228, the needle bar connecting stud 220, the support 212, the needle bar holding spring 226, and the support 216); to secure the needle bar connecting stud 220 to the needle bar body 110; and to secure the holder 170 to the support 216. Thus, when compared with the case described in connection with Patent Document 4, replacement of the needle bar 105 can be facilitated. In addition to replacement of the needle bar, the same also applies to a case where a needle bar is first attached. More specifically, the only requirement is to do at the time of replacement of the needle bar 105 is to handle the needle bar 105 in the same way as is an ordinary needle bar at the time of replacement of the needle bar 105 except the detachment and attachment of the needle bar 105 to the holder 170. Hence, attachment and replacement of the needle bar can be readily performed.

Figure 23:
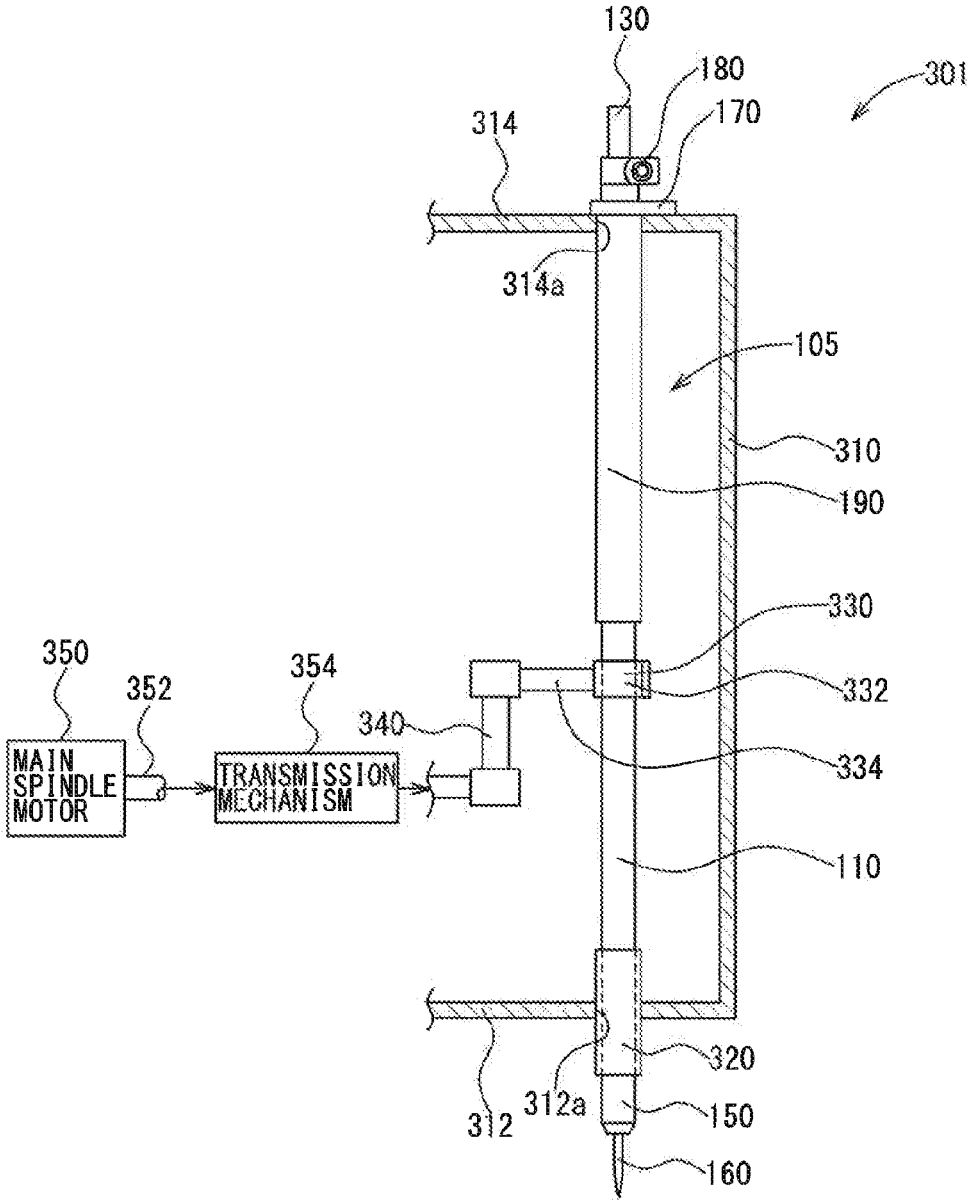
FIG. 23 is a cross-sectional view of the principal part acquired when the needle bar of the second example is applied to the embroidery sewing machine.

An example in which the needle bar 105 is applied to an ordinary sewing machine is now described. As illustrated in FIG. 23, a sewing machine 301 has the same configuration as that of the sewing machine 300 illustrated in FIG. 10 except that the needle bar 105 is attached in place of the needle bar 5.

Namely, the needle bar 105 is inserted into a tubular portion 320 and also into an insert hole 314. The holder 170 is secured to an upper surface 314 with the screw 186. In short, the upper surface 314 corresponds to a support member that fixedly supports the holder 170 with the screw (securing means) 186. A needle bar connecting stud body 332 is secured to the needle bar body 110, and a spindle 334 is secured to one end of a crank rod 340. The needle bar connecting stud 330 is vertically moved by rotation of the crank rod 340. The needle bar body 110 is vertically moved along with the vertical movement of the needle bar connecting stud 330, whereby the rotation unit 165 performs rotation. Specifically, as a result of changes occurring in the relative positions of the balls 22 in the grooves 136*a* and 136*b*, the rotation unit 165 rotates. The crank rod 340 is rotated by a transmission mechanism 354 that transmits torque stemming from a main spindle 352 that is rotated by the main spindle motor 350. A cam mechanism; for instance, is mentioned as the transmission mechanism 354. As in the case with the first example, the crank rod 230 corresponds to a needle bar connecting stud up/down mechanism that vertically moves the needle bar connecting stud. Moreover, the transmission mechanism 354, the main spindle motor 350, and the main spindle 352 also correspond to the needle bar connecting stud up/down mechanism.

Operation of the sewing machine 301 is now described. When the needle bar connecting stud 330 descends as a result of the crank rod 340 rotating from the top dead center of the needle bar 105 illustrated in FIG. 24 (*b*), the needle bar body 110 secured to the needle bar connecting stud 330 descends. In the same manner as described above, the rotation section 120 performs clockwise rotation when viewed from above, and the joint 150 and the sewing needle 160 also perform clockwise rotation when viewed from above.

Even at the bottom dead center illustrated in FIG. 24(*a*), a lower portion of the cam shaft 130 is inserted into the sleeve 122.

Next, when the needle bar connecting stud 330 ascends as a result of the crank rod 340 rotating from the bottom dead center of the needle bar 105 illustrated in FIG. 24(*a*), the needle bar body 110 secured to the needle bar connecting stud 330 ascends. In the same way as described above, the rotation section 120 performs counterclockwise rotation when viewed from above, and the joint 150 and the sewing needle 160 also perform counterclockwise rotation when viewed from above.

The rotation unit 165 performs rotation in conjunction with vertical movement of the needle bar 105 (in a narrow sense, the configuration except the cam shaft 130 and the cover 190), so that occurrence of hitch stitches can be prevented. In particular, when the needle bar 105 shifts from the bottom dead center to the top dead center, the sewing needle 160 performs 120-degree counterclockwise rotation when viewed from above. When the needle bar 105 shifts from the top dead center to the bottom dead center, the sewing needle 160 performs 120-degree clockwise rotation when viewed from above. Hence, occurrence of hitch stitches can be prevented. The principle of prevention of hitch stitches is the same as that described in connection with the first example, and hence its detailed explanation is omitted.

At the time of replacement of the needle bar 105, the needle bar connecting stud 330 is unfastened from the needle bar body 110, and the holder 170 is unfastened from the upper surface 314 by unscrewing the screw 186 which secures the holder 170, whereby the needle bar 105 can be pulled upward. Moreover, at the time of attachment of a new needle bar 105, the essential requirement is to insert the needle bar 105 into respective members (specifically, the upper surface 314, the needle bar connecting stud 330, and the tubular portion 320); to secure the needle bar connecting stud 330 to the needle bar body 110; and to fix the holder 170 to the upper surface 314. Accordingly, replacement of the needle bar 105 can be facilitated. In addition to replacement of the needle bar, the same also applies to a case where a needle bar is first attached. More specifically, the only requirement is to do at the time of replacement of the needle bar 105 is to handle the needle bar 105 in the same way as is an ordinary needle bar at the time of replacement of the needle bar 105 except the detachment and attachment of the needle bar 105 to the holder 170. Hence, attachment and replacement of the needle bar can be readily performed.

In relation to the needle bar 105 of the present example, the sewing needle 160 can be rotated by vertical movement of the needle bar body 110. There is no necessity of an additional rotation mechanism for rotating a needle bar, like a motor and gears.

Furthermore, all you need to do at the time of replacement of the needle bar 105 is to handle the needle bar 105 in the same way as is an ordinary needle bar at the time of replacement of the needle bar 5 except the detachment and attachment of the needle bar 5 to the holder 170. Hence, attachment and replacement of the needle bar can be easily attached and replaced.

A plurality of types of needle bars that differ from each other in terms of the configuration of the grooves 136*a* and 136*b* of the cam shaft 130 are prepared, so that a needle bar can be replaced with an appropriate one according to a type of a fabric to be sewn, thread types (a needle thread and a bobbin thread), and an embroidery pattern. Conceivable configurations of the grooves 136*a* and 136*b* include the helical portions 136*a*-2 and 136*b*-2 having different lengths and the helical portions 136*a*-2 and 136*b*-2 having different rotation angles from their upper to lower ends.

In the needle bar 105, the balls 22 fitted in the respective openings 120*a* and 120*b* of the sleeve 122 are in engagement with the grooves 136*a* and 136*b*. The balls 22 rotate within the openings 120*a* and 120*b* and the grooves 136*a* and 136*b* at the time of rotation of the sleeve 122. Accordingly, friction between the balls 22 and the sleeve 122 and friction between the balls 22 and the cam shaft 130 can be diminished, so that the rotation unit 165 can perform smooth rotation. Moreover, the pair of openings 120*a* and 120*b* are formed in the sleeve 122, and the pair of grooves 136*a* and 136*b* are formed in the cam shaft 310. The balls 22 are fitted in the respective openings and grooves. Hence, even in this regard, the rotation unit 165 can smoothly rotate.

The needle bar 105 of the present example can be readily applied to existing sewing machines. Specifically, as can be seen from a comparison between FIG. 22 and FIG. 13, the essential requirement for the case of an embroidery sewing machine is to provide the needle bar case 210 with the support 216 for fixing the holder 170. Consequently, the needle bar 105 can be readily applied to existing sewing machines. Further, even in the case of ordinary sewing machines, the essential requirement is to remove the tubular portion 350 from the configuration of the existing example illustrated in FIG. 14 and secure the holder 170 of the needle bar 105 to the upper surface 314. Therefore, the needle bar 105 an be readily applied to existing sewing machines. Even in the case of a comparison with the needle bar rotation mechanism described in connection with Patent Document 4, the needle bar rotation mechanism of Patent Document 4 needs space for a needle bar support and a brace. However, in the present example, the needle bar can be easily applied to existing sewing machines, so long as there is adopted a configuration in which the holder 170 is secured.

Figure 26:
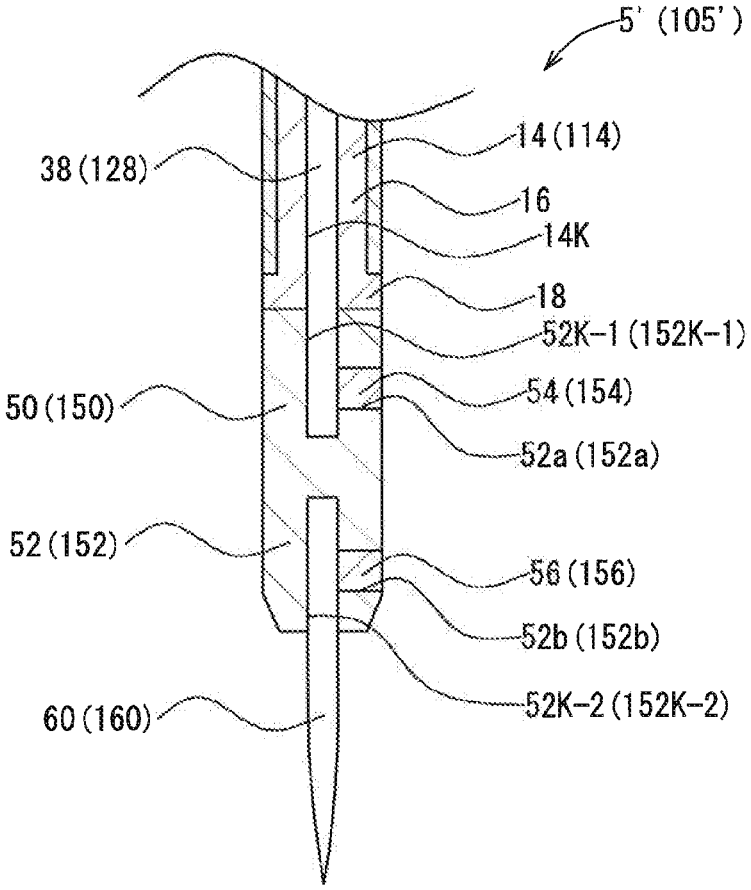
FIG. 26 is a longitudinal cross-sectional view of a modification of the first and second examples.
Figure 27:
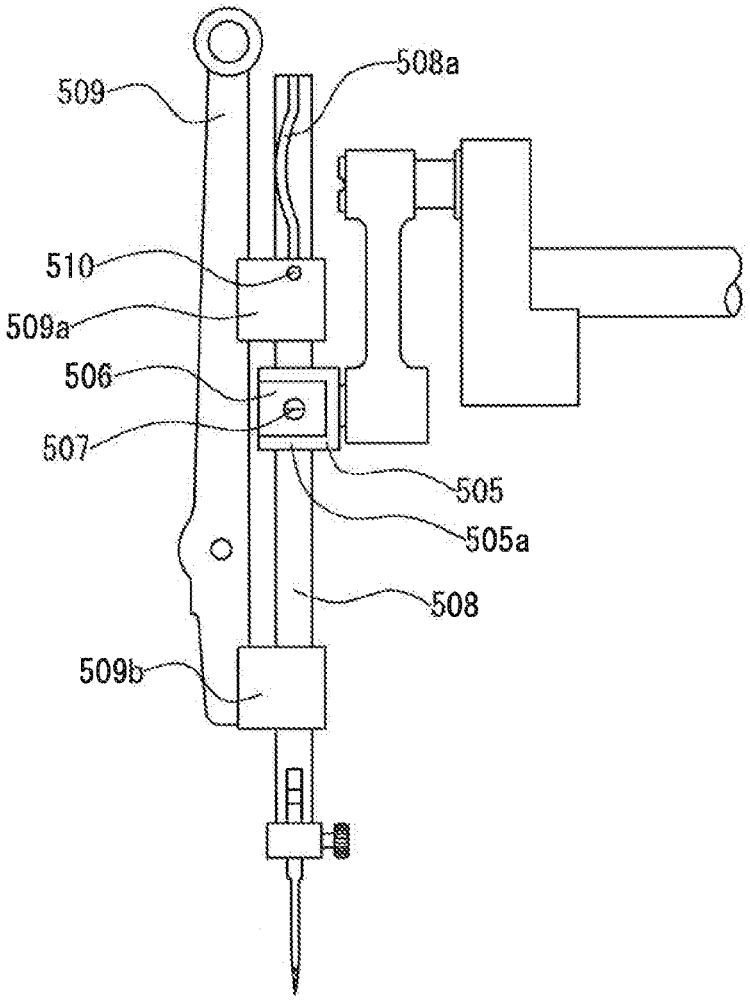
FIG. 27 is a front view showing an existing needle bar rotation mechanism (Patent Document 4).

In the first example, the insert hole 52K for insertion of the lower shaft 38 and the sewing needle 60 is opened in the joint 50. In the second example, the insert hole 152K for insertion of the lower shaft 128 and the sewing needle 160 is opened in the joint 150. However, in relation to the first example, a hole (a first hole) for insertion of the lower shaft 38 and another hole (a second hole) for insertion of the sewing frame 60 may also be separately provided. The hole for insertion of the lower shaft 38 is opened in the upper end of the joint 50, and the hole for insertion of the sewing needle 60 is opened in the lower end of the joint 50. The two holes can also be formed in line with each other. In relation to the second example, a hole (a first hole) for insertion of the lower shaft 128 and another hole (a second hole) for insertion of the sewing frame 160 may also be separately provided. The hole for insertion of the lower shaft 128 is opened in the upper end of the joint 150, and the hole for insertion of the sewing needle 160 is opened in the lower end of the joint 150. The two holes can also be formed in line with each other. Specifically, as illustrated in FIG. 26, a hole 52K-1 for insertion of the lower shaft 38 and a hole 52K-2 for insertion of the sewing frame 60 are separately provided in the joint 50. The hole 52K-1 and the hole 52K-2 are formed in line with each other. Moreover, as illustrated in FIG. 26, a hole 152K-1 for insertion of the lower shaft 128 and a hole 152K-2 for insertion of the sewing frame 160 are separately provided in the joint 50. The hole 152K-1 and the hole 152K-2 are formed in line with each other.

The respective sections that make up the needle bars 5 and 105 and the sewing machines 200, 201, 300, and 301 described above can also be made from materials other than those described above. In Figures, the direction Y1-Y2 is orthogonal to the direction X1-Z2, whereas the direction Z1-Z2 is orthogonal to the direction X1-X2 and the direction Y1-Y2.

DESCRIPTION OF REFERENCE NUMERALS

5, 105 NEEDLE BAR
10, 110 NEEDLE BAR BODY
10-1 SMALL-DIAMETER PORTION
10-2 LARGE-DIAMETER PORTION
12, 112 VERTICALLY-MOVABLE SLEEVE
14, 114 GUIDE BUSH
20, 122 SLEEVE
20*a*, 20*b*, 120*a*, 120*b* OPENING
22 BALL
30, 130 CAM SHAFT
32 DISC-SHAPED PORTION
34 UPPER SHAFT
36*a*, 36*b*, 136*a*, 136*b* GROOVE
38 LOWER SHAFT
40 RING
50, 150 JOINT
52, 152 JOINT BODY
52*a*, 52*b*, 152*a*, 152*b* THREADED HOLE
52K, 52K-1, 52K-2, 152K, 152K-1, 152K-2 HOLE
54, 56, 154, 156 SCREW
60, 160 SEWING NEEDLE
70, 170 HOLDER
71, 171 HOLDER BODY
80, 180 BOLT
86 SCREW
90, 190 COVER
120 ROTATION SECTION
124 GUIDE PIN
126 DISC-SHAPED PORTION
128 SHAFT
130 CAM SHAFT
200, 201, 301, 300, 200', 300' SEWING MACHINE
201 ARM
206 NEEDLE BAR UP/DOWN COMPONENT
210 NEEDLE BAR CASE
216 SUPPORT
220, 330 NEEDLE BAR CONNECTING STUD
314 UPPER SURFACE

The invention claimed is:

1. A sewing needle bar comprising:

a tubular needle bar body including a small-diameter portion which is provided at a lower end of the needle bar body and which has a hole opened along an axis line of the needle bar body and a large-diameter portion which is continually provided on an upper side of the small-diameter portion and which has a hole opened larger in diameter than the hole of the small-diameter portion and along the axis line of the needle bar body;

a cylindrical sleeve which is inserted in the hole of the large-diameter portion of the needle bar body and which has an opening for placing a ball;

a cam shaft including a disc-shaped portion which is placed on an upper surface of the small-diameter portion in the needle bar body in a rotatable manner and which has an outer diameter larger than a diameter of the hole of the small-diameter portion, a spindle-shaped upper shaft which is formed upwardly from the upper surface of the disc-shaped portion and remains inserted in the sleeve and whose outer circumferential surface has a clockwise helical groove, and a spindle-shaped lower shaft which is formed downwardly from a lower surface of the disc-shaped portion and remains inserted in the hole of the small-diameter portion of the needle bar body and which protrudes downwardly from a lower end of the small-diameter portion;

the ball which is placed in the opening of the sleeve and which come into engagement with the groove of the upper shaft; and a joint which is secured to the lower shaft while the small-diameter portion of the needle bar body are sandwiched between the joint and the disc-shaped portion and which secures a sewing needle, wherein changes occur in relative positions of the ball in the groove as a result of the needle bar body being vertically moved while a portion of the sleeve protruding upward from the needle bar body remains fixed, whereupon the cam shaft and the joint rotate.

2. The needle bar according to claim 1, wherein the opening of the sleeve is provided as a pair;

the pair of openings are positioned opposite with an axis line of the sleeve sandwiched therebetween;

the groove of the upper shaft is provided as a pair;

the pair of grooves are at positions that are symmetrical about an axis line of the upper shaft; and the ball is provided as a pair, wherein one of the pair of balls is placed in one of the openings and in engagement with one of the grooves, and the other of the pair of balls is placed in the other of the grooves and in engagement with the other of the grooves.

3. The needle bar according to claim 1, further comprising a holder which holds a sleeve and is provided on a portion of the sleeve protruding upward from the needle bar body and which has securing means for securing the holder to a support member of the sewing machine.

4. The needle bar according to claim 3, wherein the holder has a cylindrical cover which extends downwards and which covers a portion of the sleeve exposed from the needle bar body and an upper end of the needle bar body.

5. A sewing needle bar comprising:

a tubular needle bar body including a small-diameter portion which is provided at a lower end of the needle bar body and which has a hole opened along an axis line of the needle bar body and a large-diameter portion which is continually followed by the small-diameter portion and which has a hole larger in diameter than the hole of the small-diameter portion opened along the axis line of the needle bar body;

a rotation section including a cylindrical sleeve which is inserted in the hole of the large-diameter portion of the needle bar body and which has an opening for placement of a ball, a disc-shaped portion which is fixed to a lower end of the sleeve and provided on an upper surface of the small-diameter portion in the needle bar body in a rotatable manner and which has an outer diameter larger than a diameter of the hole of the small-diameter portion, and a spindle-shaped lower shaft which is formed downwardly on a lower surface of the disc-shaped portion and inserted in the hole of the small-diameter portion of the needle bar body and which protrudes downwardly from a lower end of the small-diameter portion;

a cam shaft which is inserted in the sleeve and whose outer circumferential surface has a clockwise helical groove;

the ball which is placed in the opening of the sleeve and which come into engagement with the groove of the cam shaft; and a joint which is secured to the lower shaft of the rotation section with the small-diameter portion of the needle bar body sandwiched between the joint and the disc-shaped portion and which secures a sewing needle, wherein changes occur in relative positions of the ball in the groove as a result of vertical movement of the needle bar body while a portion of the cam shaft protruding upward from the needle bar body and the sleeve is secured, whereupon the rotation section and the joint rotate.

6. The needle bar according to claim 5, wherein the opening of the sleeve is provided as a pair;

the pair of openings are positioned opposite with an axis line of the sleeve sandwiched therebetween;

the groove of the cam shaft is provided as a pair;

the pair of grooves are placed at positions which are symmetrical about an axis line of the cam shaft; and the ball is provided as a pair, wherein one of the pair of balls is placed in one of the openings and in engagement with one of the grooves, and the other of the pair of balls is placed in the other of the grooves and in engagement with the other of the grooves.

7. The needle bar according to claim 5, further comprising a holder which holds the cam shaft and is provided on a portion of the cam shaft protruding upward from the needle bar body and the sleeve and which has securing means for securing the holder to a support member of the sewing machine.

8. The needle bar according to claim 7, wherein the holder has a cylindrical cover which extends downwards and which covers a portion of the cam shaft exposed from the needle bar body and an upper end portion of the needle bar body.

9. The needle bar according to claim 1, wherein the needle bar body has a cylindrical needle bar body sleeve and a guide bush that is provided at a lower end of the needle bar body sleeve and that includes a cylindrical guide bush body and a cylindrical flange formed so as to protrude from an outer circumferential surface of a lower end of the guide bush body;

a portion of the guide bush body where no flange is formed is fixedly provided within the needle bar body sleeve;

a portion of the needle bar body from an upper end of the needle bar body sleeve to an upper end of the guide bush along a heightwise direction of the needle bar body makes up a large-diameter portion; and a portion of the needle bar body from the upper end to a lower end of the guide bush in the heightwise direction of the needle bar body makes up a small-diameter portion.

10. The needle bar according to claim 1, wherein the joint has a joint body including a hole for insertion of the lower shaft and the sewing needle, a lower-shaft-securing threaded hole opened between an outer surface of the joint and the hole, and a sewing-thread-securing threaded hole opened between an outer surface of the joint and the hole;

a first screw which is to be screw-engaged with the lower-shaft-securing threaded hole, and a second screw which is to be screw-engaged with the sewing-thread-securing threaded hole; and wherein the lower shaft is secured to the joint by screw-engaging the first thread with the lower-shaft securing threaded hole while the lower shaft is inserted in the hole, and the sewing thread is secured to the joint by screw-engaging the second screw with the sewing-thread-securing threaded hole while the sewing thread is inserted in the hole.

11. The needle bar according to claim 1, wherein the joint has a joint body including a first hole for insertion of the lower shaft, a second hole for insertion of the sewing needle, a lower-shaft-securing threaded hole opened between an outer surface of the joint and the first hole, and a sewing-thread-securing threaded hole opened between an outer surface of the joint and the second hole;

a first screw which is to be screw-engaged with the lower-shaft-securing threaded hole, and a second screw which is to be screw-engaged with the sewing-thread-securing threaded hole; and wherein the lower shaft is secured to the joint by screw-engaging the first thread with the lower-shaft securing threaded hole while the lower shaft is inserted in the first hole, and the sewing thread is secured to the joint by screw-engaging the second screw with the sewing-thread-securing threaded hole while the sewing thread is inserted in the second hole.

12. A sewing machine comprising:

the needle bar defined in claim 3;

the sewing needle secured to the joint of the needle bar;

a needle bar connecting stud fixedly provided on a needle bar body of the needle bar;

a needle bar connecting stud up/down mechanism for vertically moving the needle bar connecting stud; and a support member for fixedly supporting a holder of the needle bar with the securing means.

13. The sewing machine according to claim 12, wherein the sewing machine is an embroidery sewing machine and comprises an arm having the needle bar connecting stud up/down mechanism and a needle bar case which performs horizontal sliding with respect to the arm and which is equipped with the plurality of needle bars and the support member.

14. The needle bar according to claim 2, further comprising a holder which holds a sleeve and is provided on a portion of the sleeve protruding upward from the needle bar body and which has securing means for securing the holder to a support member of the sewing machine.

15. The needle bar according to claim 6, further comprising a holder which holds the cam shaft and is provided on a portion of the cam shaft protruding upward from the needle bar body and the sleeve and which has securing means for securing the holder to a support member of the sewing machine.

16. The needle bar according to claim 2, wherein the needle bar body has a cylindrical needle bar body sleeve and a guide bush that is provided at a lower end of the needle bar body sleeve and that includes a cylindrical guide bush body and a cylindrical flange formed so as to protrude from an outer circumferential surface of a lower end of the guide bush body;

a portion of the guide bush body where no flange is formed is fixedly provided within the needle bar body sleeve;

a portion of the needle bar body from an upper end of the needle bar body sleeve to an upper end of the guide bush along a heightwise direction of the needle bar body makes up a large-diameter portion; and a portion of the needle bar body from the upper end to a lower end of the guide bush in the heightwise direction of the needle bar body makes up a small-diameter portion.

17. The needle bar according to claim 5, wherein the needle bar body has a cylindrical needle bar body sleeve and a guide bush that is provided at a lower end of the needle bar body sleeve and that includes a cylindrical guide bush body and a cylindrical flange formed so as to protrude from an outer circumferential surface of a lower end of the guide bush body;

a portion of the guide bush body where no flange is formed is fixedly provided within the needle bar body sleeve;

a portion of the needle bar body from an upper end of the needle bar body sleeve to an upper end of the guide bush along a heightwise direction of the needle bar body makes up a large-diameter portion; and a portion of the needle bar body from the upper end to a lower end of the guide bush in the heightwise direction of the needle bar body makes up a small-diameter portion.

18. The needle bar according to claim 5, wherein the joint has a joint body including a hole for insertion of the lower shaft and the sewing needle, a lower-shaft-securing threaded hole opened between an outer surface of the joint and the hole, and a sewing-thread-securing threaded hole opened between an outer surface of the joint and the hole;

a first screw which is to be screw-engaged with the lower-shaft-securing threaded hole, and a second screw which is to be screw-engaged with the sewing-thread-securing threaded hole; and wherein the lower shaft is secured to the joint by screw-engaging the first thread with the lower-shaft securing threaded hole while the lower shaft is inserted in the hole, and the sewing thread is secured to the joint by screw-engaging the second screw with the sewing-thread-securing threaded hole while the sewing thread is inserted in the hole.

19. The needle bar according to claim 5, wherein the joint has a joint body including a first hole for insertion of the lower shaft, a second hole for insertion of the sewing needle, a lower-shaft-securing threaded hole opened between an outer surface of the joint and the first hole, and a sewing-thread-securing threaded hole opened between an outer surface of the joint and the second hole;

a first screw which is to be screw-engaged with the lower-shaft-securing threaded hole, and a second screw which is to be screw-engaged with the sewing-thread-securing threaded hole; and wherein the lower shaft is secured to the joint by screw-engaging the first thread with the lower-shaft securing threaded hole while the lower shaft is inserted in the first hole, and the sewing thread is secured to the joint by screw-engaging the second screw with the sewing-thread-securing threaded hole while the sewing thread is inserted in the second hole.

20. A sewing machine comprising:

the needle bar defined in claim 7;

the sewing needle secured to the joint of the needle bar;

a needle bar connecting stud fixedly provided on a needle bar body of the needle bar;

a needle bar connecting stud up/down mechanism for vertically moving the needle bar connecting stud; and a support member for fixedly supporting a holder of the needle bar with the securing means.

* * * * *